US011787030B2

(12) United States Patent
Wirnitzer et al.

(10) Patent No.: US 11,787,030 B2
(45) Date of Patent: Oct. 17, 2023

(54) HAND-HELD POWER TOOL

(71) Applicant: Robert Bosch GmbH, Stuttgart (DE)

(72) Inventors: Bernd Wirnitzer, Friolzheim (DE); Joerg Hildebrandt, Lichtenwald (DE); Andre Kurz, Filderstadt Bonlanden (DE); Erwin Strassburger, Ludwigsburg (DE); Andreas Schlegel, Leinfelden-Echterdingen (DE); Patrick Heinen, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/418,988

(22) PCT Filed: Dec. 30, 2019

(86) PCT No.: PCT/EP2019/087131

§ 371 (c)(1),
(2) Date: Jun. 28, 2021

(87) PCT Pub. No.: WO2020/148078

PCT Pub. Date: Jul. 23, 2020

(65) Prior Publication Data

US 2022/0105616 A1 Apr. 7, 2022

(30) Foreign Application Priority Data

Jan. 17, 2019 (DE) ..... 10 2019 200 527.6

(51) Int. Cl.
*B25D 11/00* (2006.01)
*B25D 16/00* (2006.01)

(52) U.S. Cl.
CPC ..... *B25D 11/005* (2013.01); *B25D 16/006* (2013.01); *B25D 2250/131* (2013.01); *B25D 2250/201* (2013.01); *B25D 2250/221* (2013.01)

(58) Field of Classification Search
CPC ..... B25D 11/005; B25D 16/006; B25D 2250/131; B25D 2250/201; B25D 2250/221

(Continued)

(56) References Cited

U.S. PATENT DOCUMENTS 4,085,337 A * 4/1978 Moeller ..... B25B 27/0014 29/243.526
6,640,205 B2 * 10/2003 Bongers-Ambrosius ..... E21B 44/00 408/8

(Continued)

FOREIGN PATENT DOCUMENTS

DE 10 2011 081 990 A1 3/2013
DE 10 2012 208 855 A1 11/2013

(Continued)

OTHER PUBLICATIONS

International Search Report corresponding to PCT Application No. PCT/EP2019/087131, dated Apr. 15, 2020 (German and English language document) (6 pages).

*Primary Examiner* — Thomas M Wittenschlaeger
*Assistant Examiner* — David G Shutty
(74) *Attorney, Agent, or Firm* — Maginot, Moore & Beck LLP

(57) ABSTRACT

A power tool includes a housing in which a drive unit is arranged, and a tool holder for the detachable holding of a tool insert. The tool insert is configured to be driven percussively and/or rotationally. A sensor unit is configured to detect at least one movement variable, and electronics are configured to control or regulate the power tool. The electronics have a percussion detection unit configured to determine a percussion mode based on at least one movement variable and/or a rotation detection unit configured to determine a rotation of the housing. The electronics control the (Continued)

drive unit based on the determined percussion mode and/or the determined rotation of the housing. The electronics have at least two parameter sets for the percussion detection unit and/or at least two parameter sets for the rotation detection unit. The electronics are configured to select one of the at least two parameter sets.

9 Claims, 11 Drawing Sheets

(58) Field of Classification Search
USPC ..... 173/1
See application file for complete search history.

(56) References Cited

U.S. PATENT DOCUMENTS 7,320,368 B2 * 1/2008 Watanabe ..... B25D 16/006 173/217
9,314,855 B2 * 4/2016 Ookubo ..... H02P 23/03
9,923,249 B2 * 3/2018 Rejman ..... B25F 5/02
10,780,563 B2 * 9/2020 Ichikawa ..... B25D 16/006
11,059,156 B2 * 7/2021 Abe ..... B25D 17/24
11,235,453 B2 * 2/2022 Ichikawa ..... B25B 23/1475
11,247,323 B2 * 2/2022 Kumagai ..... B25B 23/1475
2002/0050364 A1 5/2002 Suzuki et al.
2005/0135084 A1 * 6/2005 Chen ..... B25B 21/00 362/109
2009/0195204 A1 * 8/2009 Gumpert ..... G01H 1/003 318/460
2012/0100405 A1 * 4/2012 Noda ..... H01M 10/4257 429/90
2013/0335013 A1 * 12/2013 Suzuki ..... H01M 50/213 307/154
2014/0368149 A1 12/2014 Stock et al.
2015/0101835 A1 * 4/2015 Nitsche ..... B25D 16/006 173/201
2016/0089757 A1 * 3/2016 Wirnitzer ..... B23Q 11/0092 173/2
2016/0129576 A1 * 5/2016 Nishikawa ..... B25D 16/006 173/2
2016/0129578 A1 * 5/2016 Sprenger ..... B25F 5/001 173/1
2016/0279776 A1 * 9/2016 Wirnitzer ..... B25D 11/005
2017/0190032 A1 * 7/2017 Leong ..... B25F 5/00
2018/0370008 A1 * 12/2018 Peters ..... B25F 5/006
2022/0105616 A1 * 4/2022 Wirnitzer ..... B25D 11/005

FOREIGN PATENT DOCUMENTS

DE 10 2014 219 392 A1 3/2016
DE 10 2015 214 368 A1 6/2016
DE 10 2015 214 388 A1 6/2016
DE 10 2016 203 925 A1 9/2017
DE 10 2017 103 003 A1 8/2018
EP 3 143 689 B1 3/2017
JP 2018-69394 A 5/2018
WO 02/19048 A2 3/2002
WO 2013/174599 A1 11/2013
WO 2015/110245 A1 7/2015

* cited by examiner

HAND-HELD POWER TOOL

This application is a 35 U.S.C. § 371 National Stage Application of PCT/EP2019/087131, filed on Dec. 30, 2019, which claims the benefit of priority to Serial No. DE 10 2019 200 527.6, filed on Jan. 17, 2019 in Germany, the disclosures of which are incorporated herein by reference in their entirety.

BACKGROUND

DE 10 2012 208 855 describes a sensor unit for a hand-held power tool having a percussion mechanism, the sensor unit having a sensor for at least one mechanical measured variable intended to detect at least one percussion characteristic.

SUMMARY

The disclosure alternatively relates to an operating-mode switching device of a hand-held power tool, having an operating element that in particular can be operated manually, having a position determining unit that is designed to provide at least one item of switching position information of the operating-mode switching device to an electronics system, the position determining unit having at least one signal generator element and having at least two sensor elements for sensing a signal of the signal generator element. It is proposed that the at least two sensor elements are arranged in such a manner that, in at least one switching position, the two sensor elements sense the signal of a single signal generator element. Advantageously, particularly reliable determination of the switching position can thereby be ensured.

A hand-held power tool in this context is to be understood to mean, in particular, an appliance for performing work on workpieces by means of an electrically driven insert tool. Typical hand-held power tools in this context are hand-held or bench power drills, screwdrivers, rotary percussion drills, hammer drills, jigsaws, circular saws, miter saws, planes, angle grinders, orbital sanders, polishing machines or the like. The hand-held power tool may be a cable-connected mains-powered appliance a cordless battery-powered appliance. The operating-mode switching device is designed, in particular, to switch between at least two different operating modes of the hand-held power tool. In this context, different operating modes of the hand-held power tool is to be understood to mean, in particular, that an insert tool connected to the hand-held power tool executes a different drive motion, for example a rotating, linearly oscillating, or rotating and linearly oscillating drive motion. Alternatively or additionally, the operating mode may also be a clockwise or anti-clockwise rotation of the insert tool. It is also conceivable that different power levels become possible by means of the operating-mode switching device, for example different rotation speeds of the insert tool or a percussion energy of the hand-held power tool. By means of the operating element, the operating mode can be switched mechanically and/or electrically, or electronically. Mechanical switching in this context is to be understood to mean, in particular, that the operating element is mechanically coupled to an operating-mode switchover device, or itself performs the operating mode switchover. Electrical, or electronic, switching in this context is to be understood to mean, in particular, that the position of the operating element is provided to an electronics system that in turn triggers the operating mode switchover, for example by means of an electrical actuator or by electronic activation of a drive unit. The operating element has at least two switching positions. The electronics system is designed, in particular, to determine a switching position of the operating-mode switching device, in particular of the operating element of the operating-mode switching device, on the basis of the item of switching position information. Preferably, the electronics system is designed to activate the electrical actuator, change a direction of rotation, activate an electronic ancillary function, change a power level, or the like, in dependence on the determined switching position. The electronics system has, in particular, at least one computing unit, for example a microprocessor, for processing information. Furthermore, the electronics system may comprise electronic components such as, for example, a storage unit for storing information, electrical switches, sensor elements, etc., which are preferably arranged on a printed circuit board. The electronics system is designed, in particular, for controlling the hand-held power tool, in particular a drive unit of the hand-held power tool, by open-loop or closed-loop control. The position determining unit may be realized separately from the electronics system, or at least partially assigned to the electronics system. In particular, the sensor elements of the position determining unit are electrically connected to the electronics system, for example via a cable connection. The sensor elements are preferably arranged on a printed circuit board of the position determining unit. Alternatively, it would also be conceivable for the sensor elements to be arranged on the printed circuit board of the electronics system, or to be connected to the electronics system via a wireless communication interface. The signal generator element is designed, in particular, to alter a physical variable in its environment. The physical variable in this case corresponds to the signal. The signal may be realized, for example, as a magnetic signal, an optical signal, an inductive signal, a capacitive signal, etc. The signal emitted by the signal generator element may be binary, analog or digital. An analog signal is to be understood to mean, in particular, a signal that can assume substantially an infinite number of values between two limit values. A digital signal is to be understood to mean, in particular, a signal that can assume a finite number of values between two limit values. A binary signal is to be understood to mean, in particular, a two-stage digital signal. The sensor elements are in particular designed to determine an item of switching position information in each case, based on the signal of the signal generator element.

It is furthermore proposed that at least one of the sensor elements is designed to provide a binary item of switching position information to the electronics system. Preferably, the at least two sensor elements are designed to provide a binary item of switching position information to the electronics system, In particular, the at least two sensor elements are designed to determine the item of switching position information by means of a threshold procedure.

It is furthermore proposed that the electronics system is designed to determine the switching position in dependence on the items of switching position information of the at least two sensor elements. Advantageously, a particularly reliable determination of the switching position can thereby be ensured. In particular, the electronics system is designed to determine a switching position if two items of switching position information differ from each other. Advantageously, the probability of erroneous triggering can thereby be minimized. It is additionally proposed that the signal generator element is mechanically connected to the operating element. Exemplarily, the signal generator element may be connected to the operating element in a non-positive and/or positive manner, or also in a materially bonded manner. Preferably, the operating element has receiving pockets in which the signal generator elements are arranged. The operating element is in particular realized in a linearly movable or rotatably mounted manner. Preferably, the operating-mode switching device is realized in such a manner that the operating element latches into the switching positions. The number of switching positions corresponds in this case to the number of latch-in positions of the operating element.

It is furthermore proposed that the operating-mode switching device has at least two signal generator elements, the signals of the at least two signal generator elements each being able to be sensed by the two sensor elements. In particular, the at least two signal generator elements are realized or arranged in such a manner that the signals sensed by the at least two sensor elements always differ from each other. As a result, advantageously, a plurality of switching positions can be sensed by means of the same sensor elements.

It is furthermore proposed that the two signal generator elements are of identical design. In particular, the sensor elements are designed to sense substantially the same signal. The sensor elements may be realized as active or as passive sensors. A passive sensor in this case is to be understood to mean, in particular, a sensor element having at least one passive component, the parameter of which can be altered by a physical variable such as, for example, an NTC. An active sensor element is to be understood to mean, in particular, an IC component such as, for example, a Hall sensor. Preferably, the at least two sensor elements are realized as magnetic field sensors, for example as Hall sensors. The Hall sensors may be realized, for example, as unipolar or bipolar sensors.

Alternatively or additionally, it is likewise conceivable for at least one sensor element, in particular at least two sensor elements, to be realized as a microswitch or as a reed switch. It is also conceivable for the signal generator element to be realized as a specially prepared surface. Exemplarily, it is conceivable for a surface of the operating-mode switching device, in particular a surface of the operating element, to have a particular surface, a particular roughness, a particular conductivity, etc., that differs from the surroundings and thus forms the signal generator element.

It is furthermore proposed that the two signal generator elements are arranged in relation to each other in such a manner that the second signal generator element, irrespective of the position of the operating element, can never assume the same position, relative to the two sensor elements, as the first signal generator element. It can thereby be ensured, advantageously, that the switching position is reliably determined even in the case of sensor elements that are the same.

The disclosure furthermore relates to a hand-held power tool, in particular a hammer drill, having an operating-mode switching device that in particular can be operated manually, and having a position determining unit that is designed to provide at least one item of switching position information of the operating-mode switching device to an electronics system, the position determining unit having at least one signal generator element and having at least two sensor elements for sensing a signal of the signal generator element. It is proposed that the at least two sensor elements are arranged in such a manner that, in at least one switching position, the two sensor elements sense the signal of a single signal generator element. The manual actuation in this case may be effected directly via the operating element, or alternatively indirectly via a mechanical coupling to a coupling element such as, for example, a tension band, a cable pull, etc., that is connected to a further operating element.

The disclosure additionally relates to a procedure for controlling a hand-held power tool, comprising the following steps:

providing a switching position of an operating-mode switching device;

deactivating a percussion detection unit and/or a rotation detection unit on the basis of the switching position.

The provision of the switching position is effected, in particular, via a position determining unit, which has at least two sensor elements and at least one signal generator element, the two sensor elements per signal generator element sensing two items of switching position information and providing them to an electronics system that determines the switching position on the basis of the two items of switching position information. The percussion detection by means of the percussion detection unit and the rotation detection by means of the rotation detection unit are electronic ancillary functions of the hand-held power tool that make the use of the hand-held power tool more convenient and safer for the user.

It is furthermore proposed that the procedure comprises the additional step: deactivating the rotation detection unit if the switching position corresponds to a chiseling operation. A chiseling operation is to be understood to mean, in particular, an operating mode of the hand-held power tool in which the insert tool is driven exclusively in a linearly oscillating manner. Advantageously, erroneous triggering can be avoided by deactivation of the rotation detection unit during chiseling operation.

It is furthermore proposed that the procedure comprises the additional step: deactivating the percussion detection unit if the switching position corresponds to an anti-clockwise hammer-drilling operation. A hammer-drilling operation is to be understood to mean, in particular, an operating mode of the hand-held power tool in which the insert tool is driven in a rotational and linearly oscillating manner.

The disclosure relates to a hand-held power tool, having a housing in which a drive unit is arranged, having a tool receiver for detachably receiving an insert tool, wherein the insert tool can be driven percussively and/or rotationally, having a sensor unit for sensing at least one motion variable, having an electronics system, for controlling the hand-held power tool by open-loop or closed-loop control, which has a percussion detection unit for determining a percussion mode on the basis of the at least one motion variable and/or a rotation detection unit for determining a rotation of the housing, wherein the electronics system controls the drive unit on the basis of the determined percussion mode and/or the determined rotation of the housing. It is proposed that the electronics system has at least two parameter sets for the percussion detection unit and/or at least two parameter sets for the rotation detection unit, wherein the electronics system is designed to select one of the at least two parameter sets automatically. Advantageously, this allows the hand-held power tool to be optimally adapted to different conditions.

The housing of the hand-held power tool is realized at least partially, in particular entirely, as an outer housing. The housing may be of a single-part or multipart design. The housing is made at least partially, in particular entirely, of a plastic. The sensor unit has at least one sensor, which may be realized, for example, as an acceleration, a gyro sensor, a pressure sensor, an inclination sensor, a current sensor, a rotation rate sensor, etc. Alternatively, it is also conceivable for the sensor unit to have two or more sensors, which may be of the same or a different design. A motion variable in this context is to be understood to mean, in particular, a measured variable that is sensed by the sensor unit and by means of which a motion of the hand-held power tool can be determined. The motion of the hand-held power tool may be, for example, a linear motion and/or a rotational motion of the housing of the hand-held power tool. Furthermore, the motion may also be a vibration or an oscillation acting upon the hand-held power tool or upon the housing of the hand-held power tool. The hand-held power tool has an in particular pneumatic percussion mechanism, which can be driven in an idling mode and in a percussion mode. In the idling mode and in the percussion mode, a driving motion of the drive unit is transmitted to the percussion mechanism, with the insert tool being driven in a percussive, or linearly oscillating, manner only in the percussion mode. In the idling mode, the insert tool is not driven in a percussive, or linearly oscillating, manner. In particular, the pneumatic percussion mechanism has a piston, which is mounted in a linearly movable manner in a hammer tube and which is designed to build up a piston pressure in the hammer tube. In this case, in the idling mode the piston pressure is substantially zero, or at least significantly less than in the percussion mode. This may be realized, for example, in that the hammer tube has idling control openings that are closed when a workpiece is being impinged on by the insert tool, as described, for example, in DE 10 2011 081 990 A1. Preferably, the percussion detection unit is designed to determine the percussion mode and/or the idling mode and/or a transition between the percussion mode and the idling mode. The percussion detection unit is an electronic ancillary function of the hand-held power tool by which the performance and/or the handling of the hand-held power tool is optimized. For example, if an idling mode is determined, a rotational speed of the drive unit may be lowered in order to reduce vibration for user and to ensure reliable starting of the percussion mechanism upon the transition to the percussion mode. Furthermore, if a percussion mode is determined, the rotational speed of the drive unit may be increased in order to realize a maximal material removal rate. The rotation detection unit is designed, in particular, to determine a rotation of the housing of the hand-held power tool about the work axis of the hand-held power tool. The rotation detection unit is an electronic ancillary function of the hand-held power tool by which the user is protected against sudden and unforeseeable rotations of the hand-held power tool, for example if the insert tool catches on a reinforcement. If rotation of the housing is determined, for example the drive unit may be switched off, or the rotational speed of the drive unit reduced significantly. A parameter set in this context is to be understood to mean, in particular, parameter data that are set to different processing variants by the percussion detection unit or by the rotation detection unit. The processing in this case may be the sensing or determination of a state, or mode, or a drive signal or control signal based on the determined state/mode.

It is furthermore proposed that the two parameter sets are realized in such a manner that the determination of the rotation of the housing by use of the first parameter set differs from the determination of the rotation of the housing by use of the second parameter set. It is furthermore proposed that the two parameter sets are realized in such a manner that the determination of the percussion mode by use of the first parameter set differs from the determination of the percussion mode by use of the second parameter set.

It is additionally proposed that the first parameter set and the second parameter set differ at least in a threshold. Advantageously, this allows the sensitivity of the triggering of the electronic additional function to be set automatically. The sensitivity can be increased or decreased. In this context, a higher sensitivity is to be understood to mean, in particular, a lower threshold at which the determination takes place earlier.

It is furthermore proposed that the two parameter sets are realized in such a manner that the control of the drive unit based on the determined percussion mode by use of the first parameter set differs from the control of the drive unit based on the determined percussion mode by use of the second parameter set. In particular, the first parameter set and the second parameter set differ at least in a percussion frequency of the percussion mechanism or percussion rotational speed of the drive unit. A percussion frequency, or idling frequency, in this case is to be understood to mean, in particular, a frequency of a drive element of the percussion mechanism, driven in a linearly oscillating manner in the percussion mode or idling mode, respectively. In particular, the percussion frequency corresponds substantially to the frequency at which the insert tool is driven in the percussion mode. The drive element of the percussion mechanism is realized, in particular, as a percussion piston. The percussion frequency of the percussion mechanism in the percussion mode differs, in particular, from the idling frequency of the percussion mechanism in the idling mode. In particular, the percussion frequency is higher than the idling frequency.

It is additionally proposed that the hand-held power tool has an operating switch for manually controlling the drive unit, wherein a position of the operating switch can be determined by means of an operating-switch position unit and provided to the electronics system. The operating-switch position unit may be realized, for example, as a potentiometer. Preferably, the operating-switch position unit is designed to sense or determine at least one position between a minimally settable and a maximally settable position of the operating switch.

It is furthermore proposed that the hand-held power tool has a battery pack, wherein a battery-pack operating parameter can be provided to the electronics system. The battery-pack operating parameter may be realized, for example, as an available current or as an item of temperature information. The battery-pack operating parameter may be determined by a battery-pack electronics system and provided to the electronics system of the hand-held power tool. Alternatively, it is also conceivable for the battery-pack operating parameter to be provided to the electronics system of the hand-held power tool via a coding element or a coding resistance of the battery pack.

It is furthermore proposed that the electronics system is designed to activate one of the at least two parameter sets on the basis of the operating switch position, an instantaneous rotational speed of an electric motor of the drive unit, a weight parameter and/or the battery-pack operating parameter. Advantageously, the percussion detection unit and/or the rotation detection unit can thus be optimally adapted. The instantaneous rotational speed may be determined, for example, by the electronics system of the hand-held power tool by means of suitable sensors. Various means and possibilities for determining the instantaneous rotational speed, in particular the instantaneous rotational speed of a hand-held power tool, are known to persons skilled in the art. The weight parameter may be realized, for example, as a weight of the battery pack, a weight of an accessory or as a weight of the system composed of a hand-held power tool with a battery pack and/or accessory. The accessory may be, for example, an accessory that can be detachably connected to the hand-held power tool, such as, for example, a dust extractor.

Alternatively, it is also conceivable for a user of the hand-held power tool one of the parameter sets for the rotation detection unit or the percussion detection unit via a user interface. The user interface is arranged on the hand-held power tool, or on the housing of the hand-held power tool, and is realized in particular as an HMI interface. The user interface in this case comprises in particular a display for displaying information, and an operating means. Alternatively or additionally, it is also conceivable for the user to select one of the parameter sets for the rotation detection unit or the percussion detection unit via an external device such as, for example, a smartphone. Preferably, for this purpose the hand-held power tool has a communication interface that is designed for wireless data transmission.

The disclosure additionally relates to a procedure for automatically adapting a percussion detection unit and/or a rotation detection unit of a hand-held power tool, comprising the following steps:

- providing at least two parameter sets for the percussion detection unit and/or at least two parameter sets for the rotation detection unit;
- providing a position of an operating switch, an instantaneous rotational speed, a weight parameter and/or a batter-pack operating parameter;
- selecting one of the at least two parameter sets on the basis of the position of the operating switch, the instantaneous rotational speed, the weight parameter and/or the battery-pack operating parameter, and/or deactivating the percussion detection unit and/or the rotation detection unit on the basis of the position of the operating switch, the instantaneous rotational speed, the weight parameter and/or the battery-pack operating parameter.

It is furthermore proposed that the first parameter set is activated if the position of the operating switch corresponds to a maximally settable position, wherein the first parameter set has a lesser threshold than the second parameter set. Alternatively or additionally, it is proposed that the first parameter set is activated if the instantaneous rotational speed corresponds to a maximally settable idling rotational speed, wherein the first parameter set has a lesser threshold than the second parameter set. Advantageously, a reduced sensitivity can thus be realized when the operating switch is fully depressed or under full load, enabling the number of false trips to be reduced. In particular, the second parameter set is activated if a position of the operating switch corresponds to a range of between 50% and 90% of the maximally settable position, or an instantaneous rotational speed lies in a range of between 50% and 90% of the maximally settable idling speed.

It is furthermore proposed that the battery operating parameter is realized as an available current, and the first parameter set is activated if the available current corresponds to an optimal current of the hand-held power tool, and the second parameter set is activated if the available current is less than the optimal current of the hand-held power tool. Advantageously, the hand-held power tool can thus be adapted to the available power. An "available current" in this context is to be understood to mean, in particular, a current that can be provided by the battery pack, when the hand-held power tool has been connected to the hand-held power tool, for supplying energy. Battery packs that differ, for example, in the number and/or interconnection of the battery cells arranged in them, or in the performance of the battery cells, usually have a different available current. In the case of substantially identically constructed battery packs, the available current can also differ, for example due to a different state of charge, a different state of wear, a different operating temperature and/or battery cell temperature, etc. In this context, an "optimal current of the hand-held power tool" is to be understood to mean, in particular, the current that the hand-held power tool requires in order to be operated at maximum power. Alternatively, it is also conceivable for the optimal current of the hand-held power tool to be a current that the battery pack, in a fully charged state, makes available to the hand-held power tool immediately after connection to the hand-held power tool.

It is additionally proposed that the first parameter set and the second parameter set have the same idling frequency, and/or the second parameter set has a lesser percussion frequency than the first parameter set.

Furthermore, alternatively, the disclosure relates to a hand-held power tool, in which a drive unit is arranged, having an in particular pneumatic percussion mechanism, having a tool receiver for detachably receiving an insert tool, wherein the insert tool can be driven percussively, having a sensor unit that has an acceleration sensor for sensing at least one motion variable along at least one axis of motion, and having a percussion detection unit for determining a percussion mode on the basis of the at least one motion variable. It is proposed that the acceleration sensor is designed to sense a first and/or a second harmonic of a percussion frequency or of an idling frequency of the hand-held power tool. In this way, advantageously, particularly reliable percussion can be realized. The signal of the acceleration sensor in the range of the percussion frequency in percussion operation is of a strength comparable to that of the signal of the acceleration sensor in the range of the percussion frequency in idling operation. In contrast to this, the signals of the acceleration sensor in the range of the first and the second harmonic of the percussion frequency in percussion operation are significantly stronger than in idling operation, thereby advantageously enabling very precise determination of the percussion mode, taking account of these signal ranges.

The axis of motion extends, in particular, parallel to or coaxial with the work axis of the hand-held power tool. Also conceivable, however, is an axis of motion extending perpendicularly or tangentially in relation to the work axis. A harmonic is to be understood to mean an integral multiple of a fundamental frequency, the fundamental frequency being realized as the percussion frequency, or idling frequency. In particular, the acceleration sensor is designed to sense a motion variable in a frequency range of between 0 and 500 Hz, preferably in a frequency range of between 0 and 250 Hz, preferably in a frequency range of between 0 and 150 Hz.

It is furthermore proposed that the percussion detection unit has a filter unit for filtering a motion variable. Advantageously, the accuracy of the percussion detection can thus be improved. The filter unit may be of an analog or digital design. The filter unit may have a high-pass filter, a low-pass filter and/or a band-pass filter.

It is additionally proposed that the filter unit has a high-pass filter, the high-pass filter having a cut-off frequency below the percussion frequency, in particular in a range of from 5 to 30 Hz, preferably in a range of from 5 to 15 Hz. Advantageously, low-frequency interference, for example caused by gravity or by user movements of the hand-held power tool, can thus be filtered in an efficient manner. The cut-off frequency in this case is, in particular, a mean value of a range in which the motion variable is at least partially filtered. The range preferably has a width of below 30 Hz, preferably below 15 Hz.

It is furthermore proposed that the filter unit is realized as an IIR filter. An IIR filter is to be understood to mean, in particular, a filter that has an infinite impulse response. In particular, the IIR filter is realized as a Butterworth, Chebyscheff or Bessel filter.

Advantageously, it is thereby possible to realize a particularly efficient percussion detection unit that provides optimal percussion detection even with limited computing capacities. Alternatively, it is also conceivable for the filter unit to be realized as an FIR.

It is furthermore proposed that the percussion detection unit has a verification interval and the sensor unit has a sensing interval, a ratio between the verification interval and the sensing interval being at least 10, in particular at least 25, preferably at least 50. A verification interval in this context is to be understood to mean a time period in which a threshold value comparison of the percussion detection unit is effected, and at the end of which a percussion mode or an idle mode is determined. A sensing interval in this context is to be understood to mean, in particular, a time interval at which a single motion variable is in each case sensed by the sensor unit and/or provided to the percussion detection unit. In particular, the sensor unit has a sensing interval of between 0 and 20 ms, in particular between 1 and 10 ms, preferably between 2 and 5 ms. Preferably, the percussion detection unit has a verification interval in a range of between 0 and 5 beat periods, in particular between 1 and 4 percussion periods, preferably between 2 and 3 percussion periods. Selection of a suitable verification and sensing interval enables the determination of the percussion mode to be optimized.

It is additionally proposed that the sensor unit has a current sensor and/or a rotational-speed sensor for sensing a motor variable, the percussion detection unit being designed to determine the percussion mode on the basis of the motion variable and the motor variable. In this way, advantageously, determination of the percussion mode can be further improved. The motor variable may be, for example, a current with which the electric motor is supplied, a rotational-speed profile or a rotational speed of the electric motor. In particular, a load applied to the electric motor can be determined, or at least estimated, by means of the motor variable.

The disclosure furthermore relates to a procedure for automatically controlling a rotational speed of the hand-held power tool, by open-loop or closed-loop control, comprising the following steps:

- sensing a motion variable and/or a motor variable by means of a sensor unit;
- determining an operating mode of the hand-held power tool by means of a threshold comparison of the motion variable and/or the motor variable by use of a static or dynamic threshold;
- altering, in particular increasing, a rotational speed of the hand-held power tool if a change of operating mode, in particular a transition from an idling mode to a percussion mode, is determined.

A dynamic threshold is to be understood to mean, in particular, that a plurality of parameter sets for the percussion detection unit, which differ from each other at least in a threshold, are provided to the hand-held power tool, in particular to the electronics system of the hand-held power tool, the electronics system selecting, or activating, one of the parameter sets. A static threshold is to be understood to mean, in particular, that only one parameter set is provided to the electronics system, or all parameter sets have substantially the same threshold.

It is furthermore proposed that a position of the work axis of the hand-held power tool is determined and the dynamic threshold is adapted in dependence on the position of the work axis. The position of the work axis may be sensed, in particular, via the sensor unit, preferably via the acceleration sensor. Alternatively, it is also conceivable for the sensor unit to have an additional sensor element that is designed to sense the position of the work axis of the hand-held power tool.

It is additionally proposed that a weight of the hand-held power tool is determined and the dynamic threshold is adapted in dependence on the weight. The weight may be determined, for example, by means of a weight parameter that is provided by an accessory and/or a battery pack.

It is furthermore proposed that the static threshold is determined by means of a teach-in mode. In this way, advantageously, particularly accurate percussion detection can be realized way. In the teach-in mode, the threshold, in particular a static threshold, is calibrated by the user themselves. The threshold and/or the percussion rotational speed to be applied may in this case be adapted depending on the workpiece on which work is to be performed, for example a very hard material such as granite, or brittle materials such as hollow bricks.

BRIEF DESCRIPTION OF THE DRAWINGS

Further advantages are given by the following description of the drawings. The drawings, the description and the claims contain numerous features in combination. Persons skilled in the art will expediently also consider the features individually and combine them to form further appropriate combinations. References of features of different embodiments of the disclosure that substantially correspond are denoted by the same number and by a letter indicating the embodiment.

There are shown.

DETAILED DESCRIPTION

Figure 1:
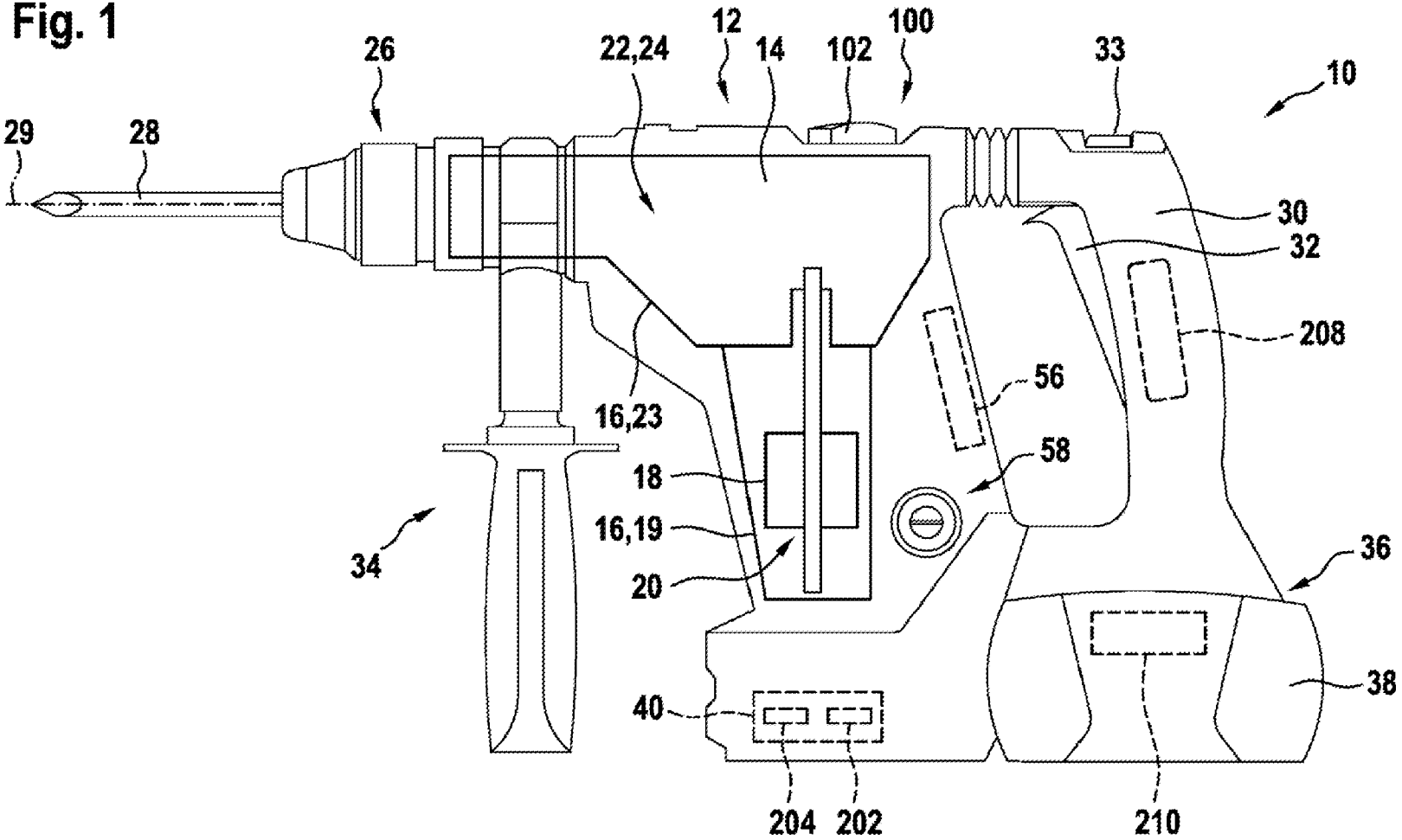
FIG. 1 a side view of a hand-held power tool.

FIG. 1 shows a side view of a hand-held power tool 10 having an operating-mode switching device 100 according to the disclosure. The hand-held power tool 10 is realized, for example, as a hammer drill. The hand-held power tool 10 has a housing 12 that comprises an outer housing 14 and an inner housing 16. Arranged in the housing 12 of the hand-held power tool 10 there is a drive unit 20, which comprises an electric motor 18 and transmits a drive motion to a transmission unit 22 that has a percussion mechanism 24. The percussion mechanism 24 is realized, for example, as a pneumatic percussion mechanism, and has an eccentric unit, not represented.

The inner housing 16 has a motor housing 19 and a transmission housing 23, which are at least partially, in particular entirely, enclosed by the outer housing 14. The percussion mechanism 24, in particular the transmission unit 22, is accommodated substantially entirely in the transmission housing 23. The transmission housing 23 encompasses a grease chamber, in which a lubricant for lubricating the gear unit 22 is at least partially arranged. The motor housing 19 is designed, in particular, for receiving and/or mounting the electric motor 18. The motor housing 19 is connected, for example via a screwed connection, to the transmission housing 23. Exemplarily, the transmission housing is made of a material different from that of the motor housing 19. Exemplarily, the transmission housing 23 is made of a metallic material, while the motor housing 19 and the outer housing 14 are made of a plastic. In particular, the transmission housing 23 has a higher strength than the motor housing 19 and/or the outer housing 14.

Via the transmission unit 22 the drive motion of the drive unit 20 is transmitted to a tool receiver 26, in which an insert tool 28 is fastened in a detachable manner. The tool receiver 26 is realized, in particular, as a drill chuck. The insert tool 28 is realized, exemplarily, so that it can be driven rotationally about, and/or in a linearly oscillating, or percussive, manner along, a work axis 29. In addition, the insert tool 28 can be driven clockwise or anti-clockwise. The work axis extends, for example, transversely, in particular substantially perpendicularly, in relation to a motor axis of the drive unit 20.

The hand-held power tool 10 has a handle 30. The handle 30 is arranged on a side of the housing 12 that faces away from the tool receiver 26. The handle 30 has an operating switch 32, via which the hand-held power tool 10 can be controlled manually, or switched on and off. The handle 30 is realized, exemplarily, as a vibration-decoupled handle 30. The handle 30 is connected to the housing 12 so as to be movable relative to the latter. Also arranged on the handle 30 is a locking switch 33, which is designed to lock the hand-held power tool 10, in particular in a chiseling operation. Furthermore, the hand-held power tool 10 has an ancillary handle 34, which is detachably connected to the housing 12. The hand-held power tool 10 is realized, exemplary, as a battery-powered hand-held power tool. Exemplarily, the hand-held power tool 10 has a battery interface 36, via which a battery pack 38 is detachably connected to the hand-held power tool 10, in particular to the handle 30.

Figure 2:
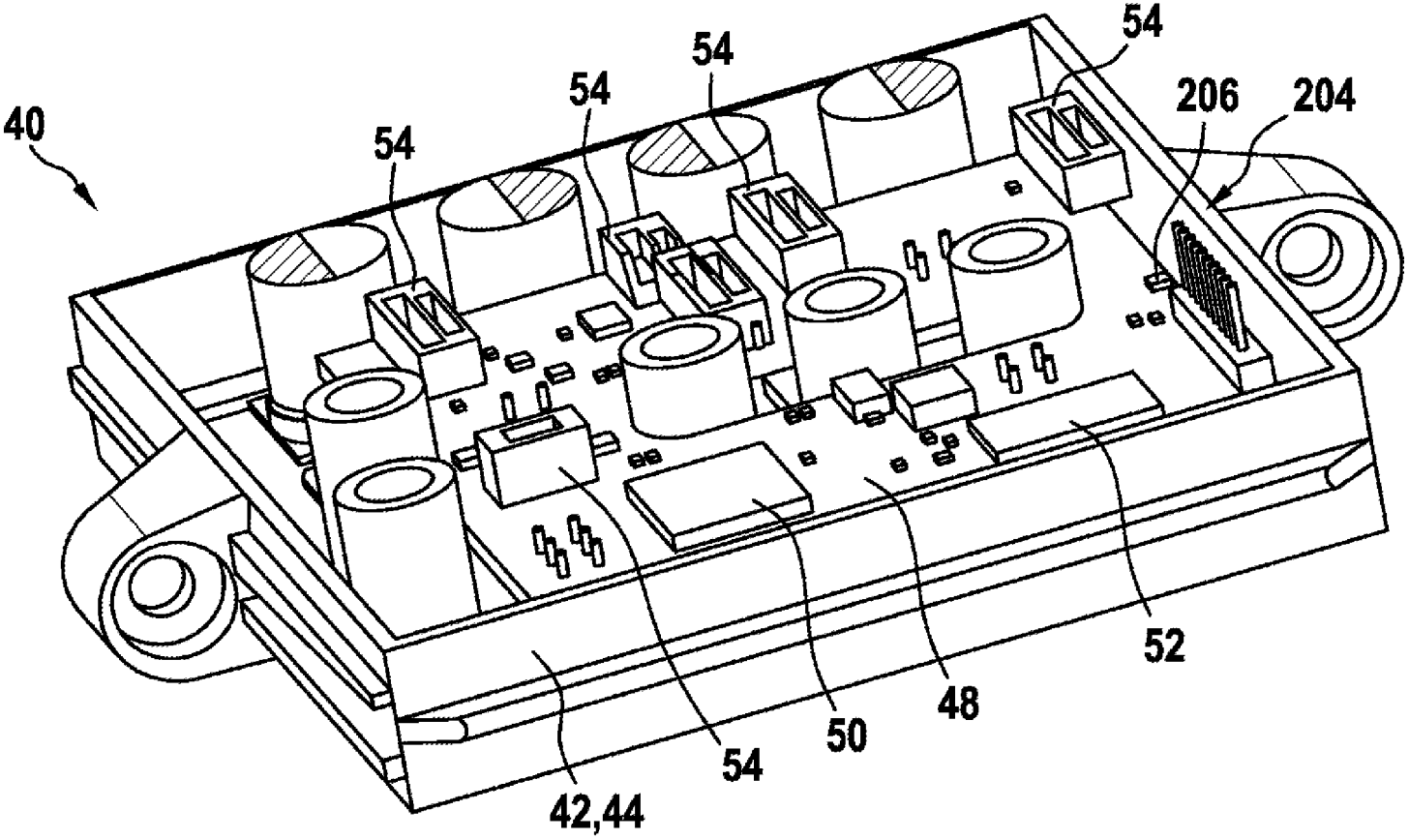
FIG. 2 a perspective view of an electronics system of the hand-held power tool.

The hand-held power tool 10 has an electronics system 40, which is designed to control the hand-held power tool 10, in particular the drive unit 20 of the hand-held power tool 10, by open-loop or closed-loop control. The electronics system 40 is arranged beneath the electric motor 18, in particular beneath the motor housing 19. The transmission unit 22, in particular the transmission housing 23, is arranged above the electric motor 18. FIG. 2 shows a perspective view of the electronics system 40. The electronics system 40 is arranged in an electronics housing 42 that is composed, exemplarily, of a lower housing part 44 and of an upper housing part, which is not represented. The electronics housing 42 is designed, in particular, to protect the electronics system 40 against the ingress of dust and/or moisture. The electronics housing 42 is enclosed substantially entirely by the outer housing 14, and connected to it. The electronics system 40 has a printed circuit board 48, on which a computing unit 50 and a storage unit 52 are arranged. Also arranged on the printed circuit board 48 of the electronics system 40 are sockets 54 that can be connected to plug-in connectors, not represented. The sockets 54 are arranged in such a manner that they can be connected to the plug-in connectors even when the electronics housing 42 is closed.

The hand-held power tool 10 additionally has a user interface 56. The user interface 56 comprises a display element, not represented in greater detail, and an interface operating element for operating the user interface 56. The display element can be used to display, for example, a state of charge of the battery pack 38 connected to the hand-held power tool 10, temperature information relating to the hand-held power tool 10 and/or the battery pack 38, a selected type of operation and/or a selected operating mode, etc. The user interface 56 is arranged on a side of the housing 12 that faces away from the tool receiver 26 and towards the handle 30.

The hand-held power tool 10 comprises a communication interface 58 for sending and/or receiving information, in particular wirelessly, to or from an external device. The external device may be realized, for example, as a computing network, as a smartphone, as a preferably portable computer, or the like. The communication interface 58 has a communication module that is detachably connected to the hand-held power tool 10. The communication module has a communication element, not represented in greater detail, designed to transmit data via Bluetooth. Alternatively, it would also be conceivable for the communication element to be designed to transmit data via another industry standard, such as WLAN or a mobile wireless network. Preferably, the communication interface 58, in particular the wireless module, has a damping element, for example in the form of an elastic sealing ring. The damping element enables the wireless module to be protected in an effective manner from the vibrations that occur during operation of the hand-held power tool. The communication interface 58 is arranged between the electronics system 40 and the transmission unit 22, in particular adjacent to the drive unit 20.

The operating-mode switching device 100, the user interface 56 and the communication interface 58 are electrically connected to the electronics system 40. The electrical connection is effected, for example, via data cables that are connected to the sockets 54 of the electronics system 40 by means of a plug-in connection.

The operating-mode switching device 100 is arranged, for example, on an upper side of the hand-held power tool 10. Alternatively, other arrangements are conceivable, such as, for example, on the side of the housing 12 of the hand-held power tool 10, in particular adjacent to the transmission unit 22. The operating-mode switching device 100 has an operating element 102 realized, for example, as a rotary knob. The operating element 102 is mounted so as to be rotatable about an operating axis 104. The operating element 102 has a grip region 106 that protrudes outward in such a manner that the operating element 102 can be gripped on the side, on the grip region 106. The operating element 102 has a marking 108 that indicates the currently selected switching position, or operating mode, to the user of the hand-held power tool 10.

The operating element 102 has, for example, four different switching positions. The operating element is preferably realized in such a manner that the operating element 102 latches into the switching positions. The four switching positions are marked on the housing 12 of the hand-held power tool 10, for example by the numbers 1 to 4, with 1 corresponding to the switching position for chiseling operation, 2 to the switching position for vario-lock, 3 to the switching position for clockwise hammer-drilling operation, and 4 to the switching position for anti-clockwise hammer-drilling operation. The chiseling operation, or switching position 1, corresponds to an operating mode in which the insert tool 28 is designed to be driven exclusively in a linearly oscillating manner. The vario-lock, or switching position 2, corresponds to an operating mode in which the tool receiver 26 is prepared, or can be aligned, for chiseling operation. The clockwise hammer-drilling mode, or switching position 3, corresponds to an operating mode in which the insert tool 28 is driven clockwise in a rotating an linearly oscillating manner. The anti-clockwise hammer-drilling mode, or switching position 4, corresponds to an operating mode in which the insert tool 28 is driven anti-clockwise in a rotating an linearly oscillating manner. The operating element 102 is designed to be rotatable by 180° in order to switch between the first and the last switching position. The rotary capability of the operating element 102 is preferably delimited by stop elements, not represented in greater detail.

Furthermore, the operating-mode switching device 100 has a position determining unit 110 for providing at least one item of switching position information to the electronics system 40. The position determining unit 110 has, for example, two signal generator elements 112, and two sensor elements 114, 115 for sensing a signal of the signal generator elements 112. The signal generator elements 112 are mechanically connected to the operating element 102. In particular, the operating element 102, on its inside, preferably on the inside of the grip region 106, has receiving pockets 116, in which the signal generator elements 112 are received in a non-positive and positive manner. The signal generator elements 112 are realized, for example, as permanent magnets, and each have a north pole 120 and a south pole 122. The signal generator elements 112 are substantially identical in design, and are of the same size and of substantially identical magnetization. The signal generator elements 112 have a substantially cylindrical basic shape. Preferably, the north pole 120 differs in shape from the south pole 122 of the signal generator element 112, thereby enabling the signal generator elements 112 to be correctly mounted in the receiving pockets 116 of the operating element 102 that match the contour. For example, the north pole 120 has a conical sub-region, while the south pole 122 is cylindrical throughout.

The two signal generator elements 112 are arranged in mirror symmetry in relation to the operating axis 104 of the operating element 102. Advantageously, it can thus be ensured that, irrespective of the selected switching position, the signal generator elements 112 can never assume the same position and orientation.

Figure 3A:
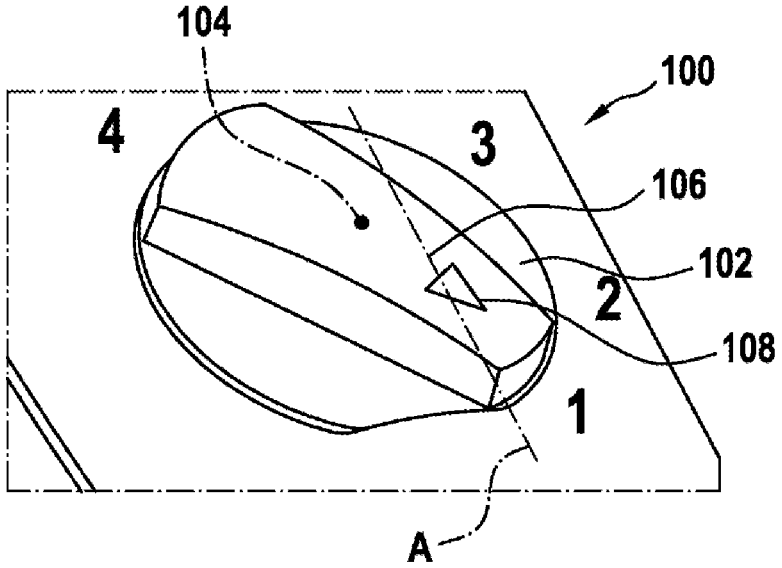
FIG. 3*a* a perspective view of an operating-mode switching device.
Figure 3B:
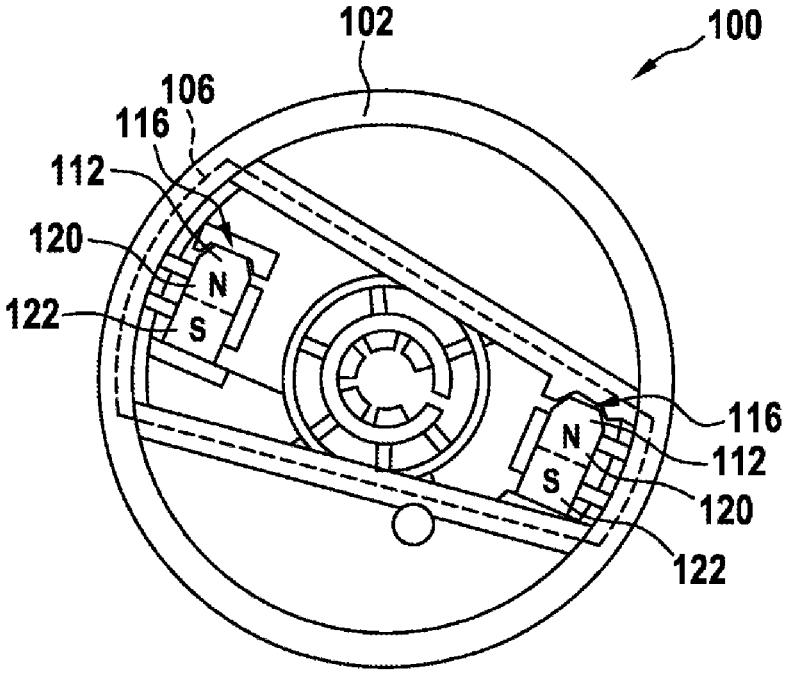
FIG. 3*b* a bottom view of an operating element of the operating-mode switching device.
Figure 4:
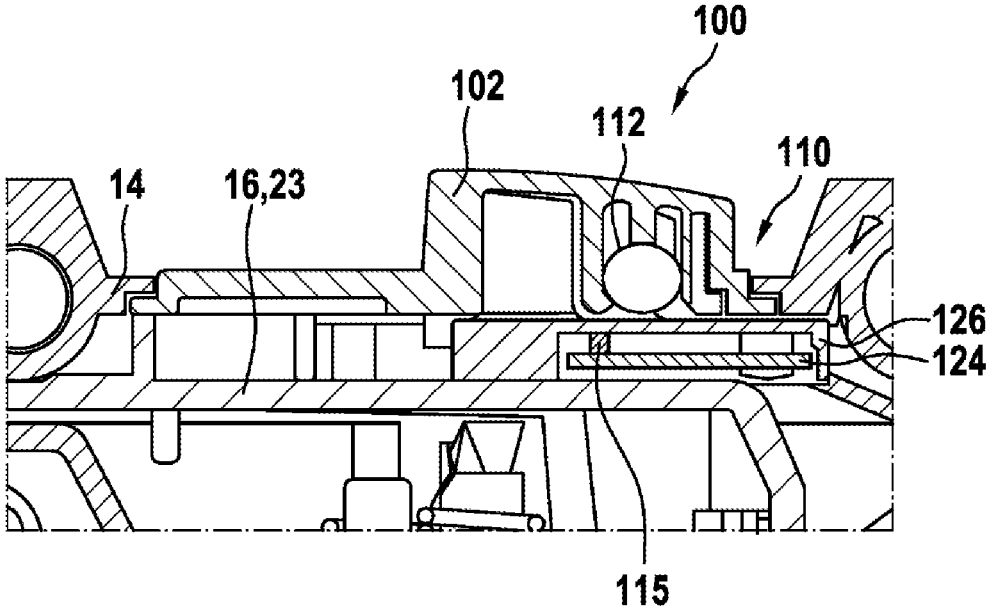
FIG. 4 a longitudinal section through the operating-mode switching device.

FIG. 4 shows a longitudinal section through the operating-mode switching device 100, along the plane A indicated in FIG. 3*a*. The plane A intersects the marking 108 of the operating element 102, under which one of the signal generator elements 112 is arranged. The signal generator element 112 is arranged in one of the receiving pockets 116 of the operating element 102, on an inner side that aces toward the inside of the housing 12 of the hand-held power tool 10. The signal generator element 112 has a round cross-section. The position determining unit 110 has a printed circuit board 124 on which the two sensor elements 114, 115 are arranged. The representation shows the first sensor elements 114, which is arranged beneath the signal generator element 112. The sensor elements 114, 115, in at least one switching position, are arranged adjacent to the signal generator elements 112, in order to sense a sufficiently strong signal. The sensor elements 114, 115 are in particular arranged between the transmission unit 22 and the operating element 102, preferably between the transmission housing 23 and the outer housing 14. As a result of the sensor elements 114, 115 being arranged outside of the transmission housing 23, they can be protected in an effective manner against abrasive particles and the lubricant. To further protect the sensor elements 114, 115, the operating-mode switching device 100 has a protective element 126 that covers the printed circuit board 124, at least one the side on which the sensor elements 114, 115 are arranged. The protective element 126 is realized, for example, as a potting compound. The protective element 126 realized as a potting compound is arranged, in particular, between the signal generator element 112 and the sensor elements 114, 115.

Figure 5:
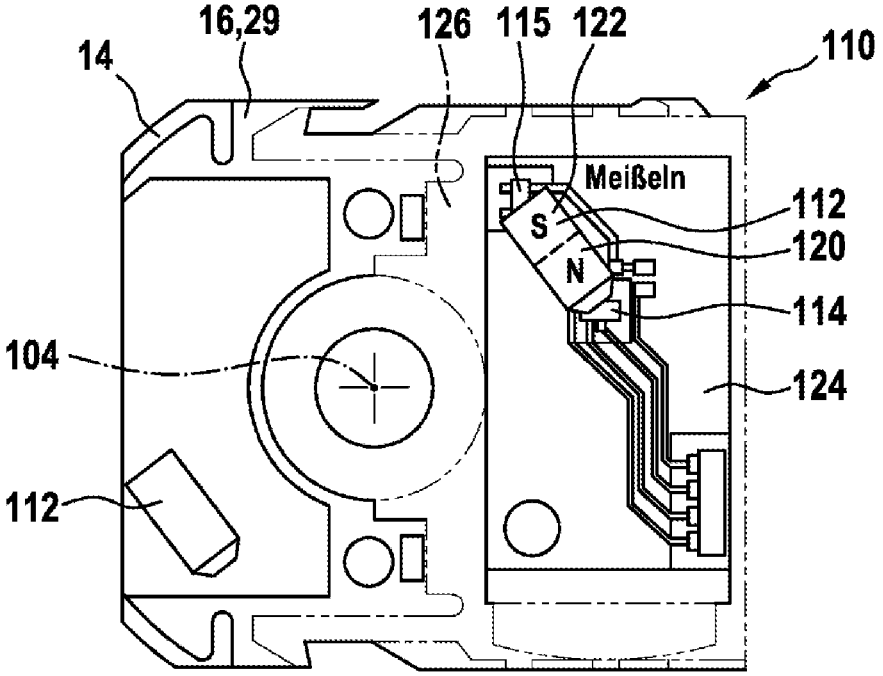
FIG. 5 a top view of the operating-mode switching device in chiseling operation.

FIG. 5 shows a top view of the operating-mode switching device 100, with the operating element 102 concealed and the protective element 126 shown in a transparent manner. As before, the operating element 102 is switched in a first switching position, which corresponds to a chiseling operation. The printed circuit board 124 of the position determining unit 110 has a rectangular shape, and is arranged entirely on a side of the operating-mode switching device 100 that faces away from the tool receiver 26. The two sensor elements 114,115 have substantially the same distance from the operating axis 104 of the operating element 102. In addition, the sensor elements 114,115 are arranged at a distance from each other on the printed circuit board 124. In particular, the two sensor elements 114,115 are spaced apart in such a manner that, in at least one switching position, for example in the first switching position, as shown, one of the signal generator elements 112 comes to lie above the sensor elements 114, 115. In particular, the sensor elements 114, 115 each have a first end region 128, and have a second end region 130 that is opposite the first end region 128. The signal generator element 112, realized as a permanent magnet, has the north pole 120 in the first end region 128, and has the south pole 122 in the second end region 130. The two sensor elements 114, 115 are each arranged adjacent to different end regions 128, 130 of the signal generator element 112. Owing to this arrangement, advantageously, the signal of the sensor element 112 above the sensor elements 114, 115 can be sensed by both sensor elements 114, 115, as shown exemplarily in FIG. 6.

Figure 6:
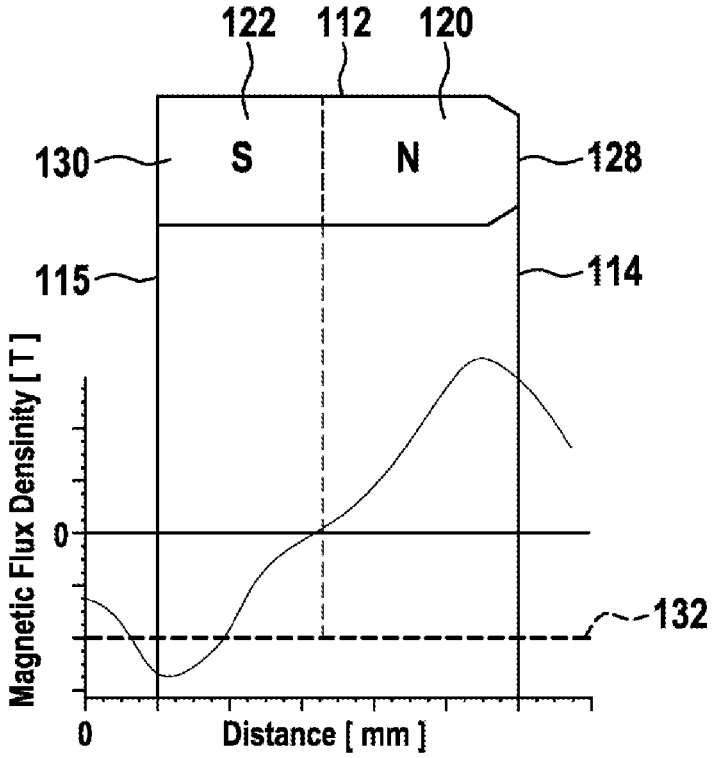
FIG. 6 a schematic illustration of a signal generator element with a diagram representing the magnetic flux density.

FIG. 6 shows a schematic illustration of the signal generator element 112 from FIG. 5 above the sensor elements 114, 115, with a diagram that exemplarily represents the magnetic flux density of the signal generator element 112 as a function of the axial position. The magnetic flux density in this case corresponds to the signal of the signal generator element 112, which is realized as an analog signal. The sensor elements 114, 115 are realized as magnetic field sensors, in particular as Hall sensors. For example, the sensor elements 114, 115 are realized as unipolar Hall sensors, the unipolar Hall sensor sensing the signal, by means of a threshold procedure, only in the region of the positive or negative polarity. For example, the sensor elements 114, 115 are realized in such a manner that the signal can be sensed in the region of the negative magnetic flux density.

The sensor elements 114, 115 are each designed to determine an item of switching position information on the basis of the sensed signal of the signal generator element 112. Preferably, the sensor elements 114, 115 are designed to determine an item of switching position information on the basis of the sensed signal, the item of switching position information being zero, negative, if a threshold 132 of the magnetic flux density is not exceeded, and the item of switching position information being one, or positive, if a threshold 132 of the magnetic flux density is exceeded.

The first sensor element 114, arranged in the first end region 128, senses the signal in the region of a substantially maximally positive flux density. Since the sensor elements 114, 115 perform a threshold-value comparison in the region of negative magnetic flux density, the switching position information signal of the first sensor element 114 is zero. The second sensor element 115, arranged in the second end region 130, senses the signal in the region of a minimally negative flux density that exceeds the threshold 132. A positive switching position information signal, or one, is determined. Owing to the sensor elements 114, 115 being arranged in regions of maximal or minimal magnetic flux densities, it can advantageously be ensured that, in the switching position, unambiguous determination of the item of switching position information is achieved.

Figure 7:
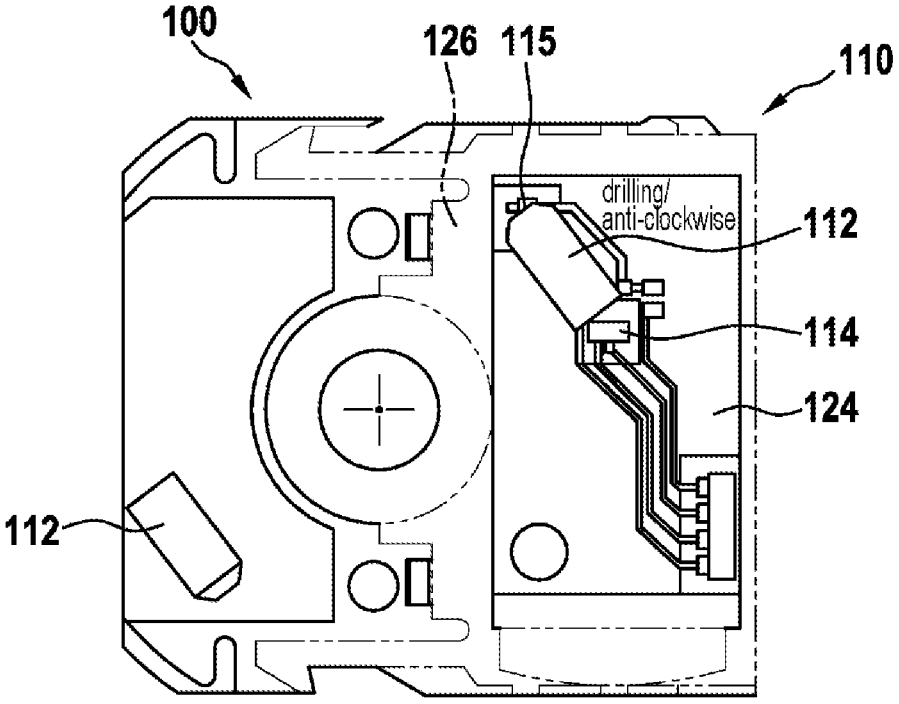
FIG. 7 a top view of the operating-mode switching device in anti-clockwise hammer-drilling mode.

FIG. 7 shows the operating-mode switching device 100 in a fourth switching position, which corresponds to an anti-clockwise hammer-drilling mode. Due to the mirror-symmetrical arrangement of the signal generator elements 112, the signal generator element 112 comes to lie above the sensor elements 114,115 in reversed orientation, such that the second sensor element 115, which previously determined a positive item of switching position information, now determines a negative item of switching position information, or 0, and the first sensor element 114, which previously determined negative item of switching position information, now determines a positive item of switching position information, or one.

The items of switching position information determined by the sensor elements 114, 115 are provided to the electronics system 40, which controls the hand-held power tool 10, by open-loop or closed-loop control, on the basis of this information. For this purpose the printed circuit board 124 has conductor tracks 134 that electrically connect the sensor elements 114, 115 to a socket 136 arranged on the printed circuit board 124. Via the socket 136, the operating-mode switching device 100 can be electrically connected to the electronics system 40 by means of a plug-in connection, not represented in greater detail.

Figure 8:
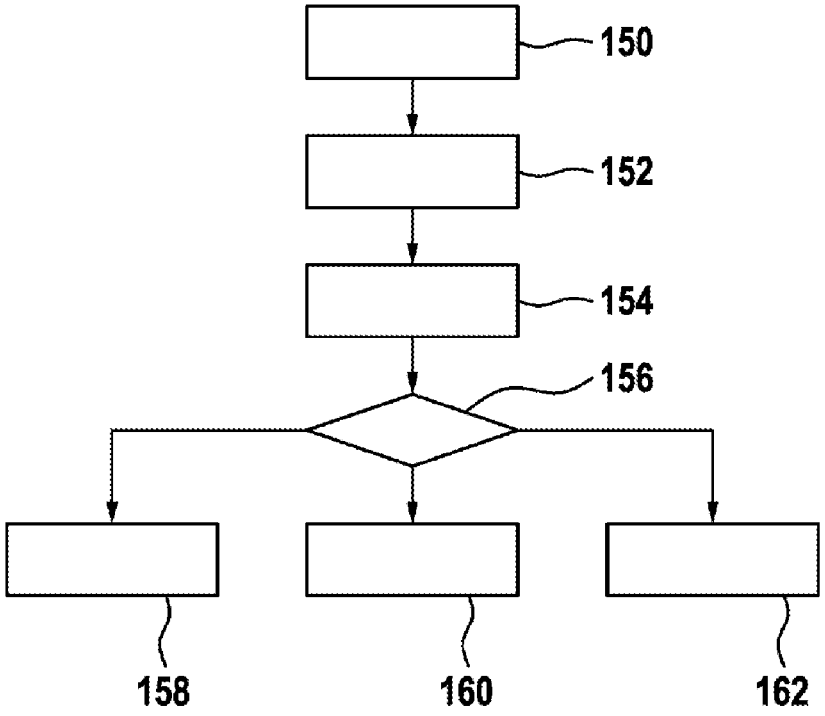
FIG. 8 a flow diagram for a control procedure based on the determined switching position.

FIG. 8, in a flow diagram, shows a possible control procedure based on the items of switching position information provided by the operating-mode switching device 100.

In a first procedure step 150, the electronics system 40 of the hand-held power tool 10 is initialized. In this initialization step, the switching position is set by the electronics system 40 to a clockwise hammer-drilling operation, such that the electric motor 18 is driven in clockwise rotation. The initialization is effected upon the hand-held power tool 10 being put into operation, for example upon the hand-held power tool 10 being connected to the battery pack 38 or upon actuation of the operating switch 32.

In a further step 152, an item of switching position information is sensed at least by a first sensor element 114 and a second sensor element 115. In this case the first sensor element 114 and the second sensor element 115 sense the item of switching position information on the basis of the signal of a single signal generator element 112. The item of switching position information is binary in form, and may be 1 if the threshold 132 is exceeded, and may be 0 if the threshold 132 is not exceeded.

In a following step 154, the item of switching position information is provided to the electronics system 40. For this purpose the sensor elements 114, 115 are electrically connected to the electronics system 40.

In a comparison step 156, the electronics system 40 determines the switching position of the operating-mode switching device 100 on the basis of the items of switching position information of the percussion detection unit 110.

If the item of switching position information of the first sensor element 114 is positive, or one, and the item of switching position information of the second sensor element 115 is negative, or zero, then, in a step 158, an anti-clockwise hammer-drilling mode is determined. Upon hammer-drilling mode having been determined, the electronics system 40 controls the drive unit 20 in anti-clockwise rotation in such a manner that the insert tool 28 is driven in anti-clockwise rotation. It is additionally conceivable that at least one electronic ancillary function is activated, deactivated or adapted. For example, it is conceivable that, upon determination of an anti-clockwise hammer-drilling mode, a percussion detection unit 202 is deactivated. Alternatively or additionally, it is conceivable to activate a rotation detection unit 204 upon determination of a hammer-drilling mode, in particular an anti-clockwise or a clockwise hammer-drilling mode. Preferably a parameter set of the rotation detection unit is adapted, such that in anti-clockwise rotation a different parameter set is used than in clockwise rotation. In particular, it is conceivable for the parameter sets to have a threshold that is dependent on the direction of rotation. Furthermore, it is conceivable for a higher rotational speed and/or a higher torque to be set in the anti-clockwise hammer-drilling mode compared to the clockwise hammer drill mode.

If the items of switching position information of the two sensor elements 114, 115 are the same, the electronics system 40, in a step 160, determines a clockwise hammer-drilling mode. For example, the two items of switching position information may be zero if the marking of the operating element 102 is located between the first and the fourth switching position, and the signal of the signal generator element 112 cannot be sensed in sufficient strength by the sensor elements 114, 115. It is also conceivable for the two items of switching position information to be one if there is a strong external magnetic field acting upon the sensor elements 114, 115, thus falsifying the sensing of the switching position information.

If the item of switching position information of the first sensor element 114 is negative, or zero, and the item of switching position information of the second sensor element 115 is positive, or one, then, in a step 162, a chiseling operation is determined. In chiseling operation an electronic ancillary function, namely the percussion detection unit, is activated by the electronics system 40. In particular, the percussion detection unit is activated only in chiseling operation. Alternatively, it is conceivable for a parameter set of the percussion detection unit in chipping operation to be adapted in comparison to the hammer-drilling mode. In addition, an electronic ancillary function, namely the rotation detection, is deactivated in chipping operation by the electronics system 40. In addition, it is conceivable for the position of the locking switch 33 to be provided to the electronics system 40, and for the locking of the operating switch 32 to be activated by the electronics system 40 only in the chipping-operation switching position.

Figure 9:
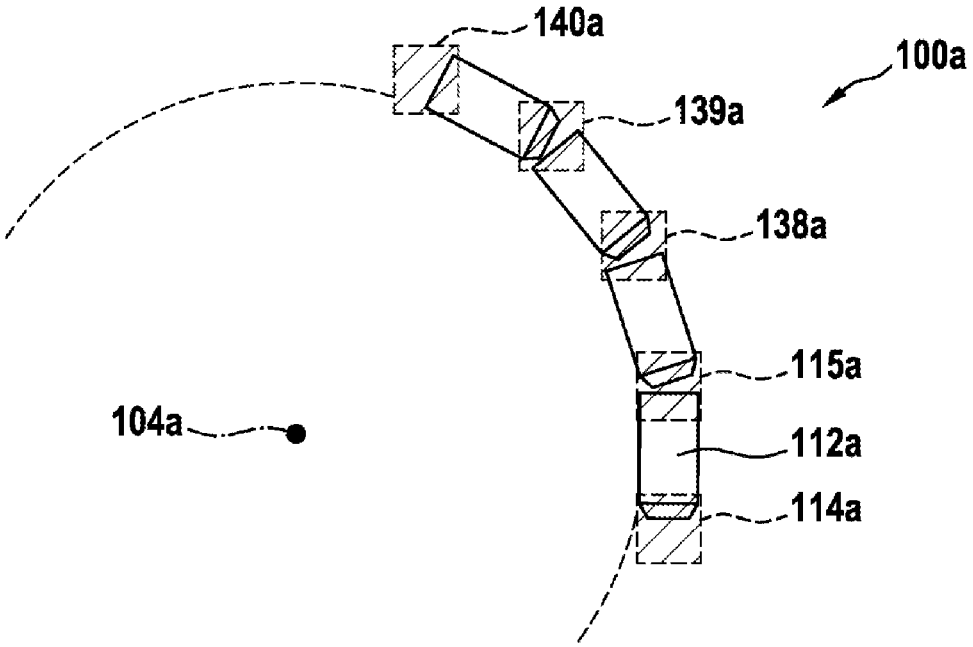
FIG. 9 an alternative embodiment of the operating-mode switching device.

FIG. 9 shows an alternative embodiment of the operating-mode switching device 100*a* in a schematic view. The operating-mode switching device 100*a* has a single signal generator element 112*a* and five sensor elements 114*a*, 115*a*, 138*a*, 139*a*, 140*a*. The signal generator element 112*a* is substantially similar in design to the previous exemplary embodiment. The signal generator element 112*a* is realized as a permanent magnet, and has a north pole 120*a*, which comprises a first end region 128*a*, and a south pole 122*a*, which comprises a second end region 130*a*. In FIG. 9 the signal generator element 112*a* is shown in four different positions, which each correspond to a switching position. The five sensor elements 114*a*, 115*a*, 138*a*, 139*a*, 140*a* have substantially the same distance from the operating axis 104*a* of the operating-mode switching device 100*a* and substantially the same distance from each other. The distance between two of the sensor elements 114*a*, 115*a*, 138*a*, 139*a*, 140*a* is preferably selected in such a manner that the distance substantially corresponds to a length of the signal generator element 112*a*. Due to this arrangement, the signal of the signal generator element 112*a* can be sensed, in each of the four switching positions, by two of the sensor elements 114*a*. In a manner similar to the previous exemplary embodiment, at least two items of switching position information are provided to the electronics system of the hand-held power tool on the basis of the sensed signal.

The hand-held power tool 10 according to FIG. 1 has two electronic ancillary functions, in the form of a percussion detection and a rotation detection, which are realized by the position determining unit 202 and the rotation detection unit 204. The percussion detection unit 202 and the rotation detection unit 204 are assigned to the electronics system 40 of the hand-held power tool 10.

The electronics system 40 has a sensor unit 205 for sensing at least one motion variable. The sensor unit 205 comprises, for example, an acceleration sensor 206 (see FIG. 2). The acceleration sensor 206 is arranged on the printed circuit board 48 of the electronics system 40. The sensor unit 205 is designed, in particular, to provide the motion variable to the electronics system 40.

The hand-held power tool 10 has an operating-switch position unit 208, which is designed to determine an operating-switch position of the operating switch 32. The operating-switch position unit 208 is arranged in the region of the operating switch 32, in particular in the handle of the hand-held power tool 10. The operating-switch position unit 208 comprises, for example, a potentiometer, but another means for determining the operating-switch position, known to persons skilled in the art, would also be conceivable. The operating-switch position unit 208 is connected to the electronics system 40, for example via a cable connection for data transmission, for the purpose of providing the operating-switch position.

The battery pack 38 connected to the hand-held power tool 10 for the purpose of supplying energy has a battery-pack electronics system 210. The battery-pack electronics system 210 is designed to determine at least one battery-pack operating parameter and/or to provide the battery-pack parameter to the hand-held power tool 10, in particular to the electronics system 40 of the hand-held power tool 10. Furthermore, the battery-pack electronics system 210 is designed to provide a weight parameter to the hand-held power tool 10, in particular to the electronics system 40 of the hand-held power tool 10.

The percussion detection unit 202 is designed to determine an idling mode and a percussion mode on the basis of the motion variable. The drive unit 20 of the hand-held power tool 10 is controlled by the percussion detection unit 202, or the electronics system 40, in dependence on the determined idling mode, or percussion mode. In particular, the drive unit 20 is controlled in such a manner that in the idling mode the drive unit 20 is driven with an idling rotational speed that is lower than a percussion rotational speed in the percussion mode. The percussion detection unit 202 has at least two parameter sets, the determination of the idling mode, or percussion mode, and/or the control of the drive unit 20 differing according to the parameter set used. The electronics system 40 is designed to select one of the parameter sets automatically. The selection is effected taking into account the switching position of the operating-mode switching device, the operating-switch position, the battery-pack operating parameter, the weight parameter and/or the instantaneous rotational speed of the hand-held power tool 10.

The rotation detection unit 204 is designed to determine a rotation of the housing 12 of the hand-held power tool 10 on the basis of the motion variable. The drive unit 20 of the hand-held power tool 10 is controlled by the rotation detection unit 204, or the electronics system 40, in particular is braked, in dependence on the determined rotation of the housing 12 of the hand-held power tool 10. Preferably, the drive unit 20 is controlled in such a manner that the drive unit 20 is braked by a range of between 50% and 100%. Preferably, the drive unit 20 is braked to a complete standstill. The rotation detection unit 204 has at least two parameter sets, the determination of the rotation of the housing 12 and/or the control of the drive unit 20 differing according to the parameter set used. The electronics system 40 is designed to select one of the parameter sets automatically. The selection is effected taking into account the switching position of the operating-mode switching device, the operating-switch position, the battery-pack operating parameter, the weight parameter and/or the instantaneous rotational speed of the hand-held power tool 10.

FIGS. 10 to 13 show examples of procedures for the selection of a parameter set, and the effect upon the determination or control by means of the percussion detection unit or rotation detection unit. The individual procedures may also be combined with each other in an appropriate manner.

Figure 10:
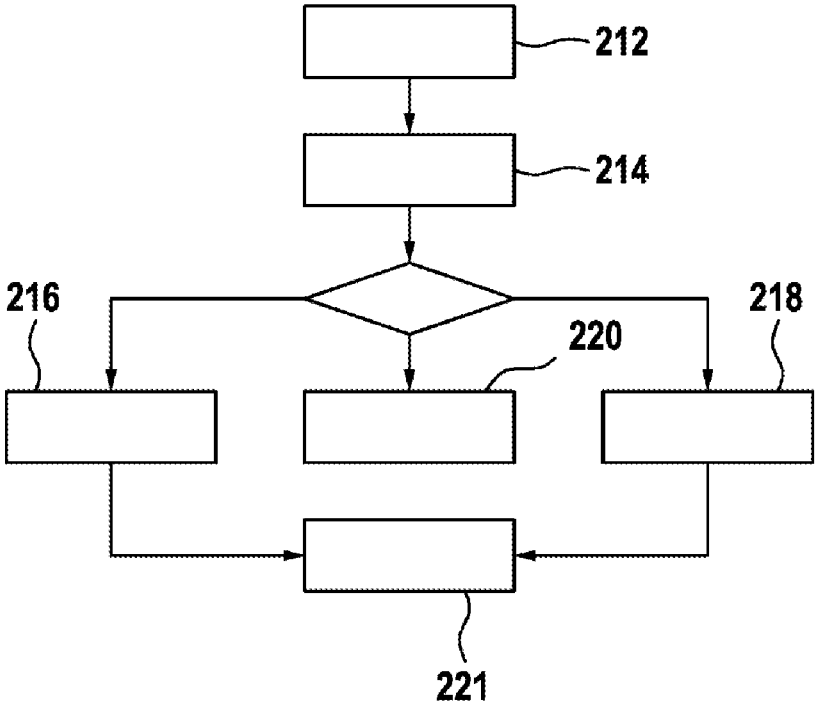
FIG. 10 a flow diagram of a procedure for selecting a parameter set for a percussion detection unit.

In FIG. 10, in a step 212, two parameter sets are provided to the percussion detection unit 202, or to the electronics system 40. The provision is effected, for example, by the storage of the two parameter sets on a storage unit of the electronics system 40, not represented.

In a further step 214, an operating-switch position is provided to the electronics system 40 via the operating-switch position unit 208.

If the provided operating-switch position corresponds substantially to a maximally settable operating-switch position, in a step 216 the electronics system 40 selects a first parameter set for the percussion detection unit 202. A maximally settable operating-switch position in this context is to be understood to mean, in particular, a position of the operating switch in which the operating switch is substantially fully depressed.

If the provided operating-switch position corresponds to a range of between 50% and 100% of the maximally settable operating-switch position, in a step 218 the electronics system 40 selects a second parameter set for the percussion detection unit 202.

If the provided operating-switch position corresponds to a range below 50% of the maximally settable operating-switch position, the percussion detection unit 202 is deactivated in a step 220.

The first parameter set has a lower threshold than the second parameter set for determination of a percussion m ode. Thus, if a motion variable sensed by the sensor unit 205 is provided to the electronics system 40, or the percussion detection unit 202, it is compared with the threshold of the first or the second parameter set, and the percussion mode is not determined, or is determined much later, if the operating-switch position does not correspond to the maximally settable operating-switch position. In this way, advantageously, the number of false triggers can be reduced significantly.

If a percussion mode is determined, then in a step 221 the rotational speed of the drive unit 20 is set to a percussion rotational speed. If the instantaneous rotational speed was previously the idling rotational speed, the idling rotational speed is increased to the percussion rotational speed.

Figure 11A:
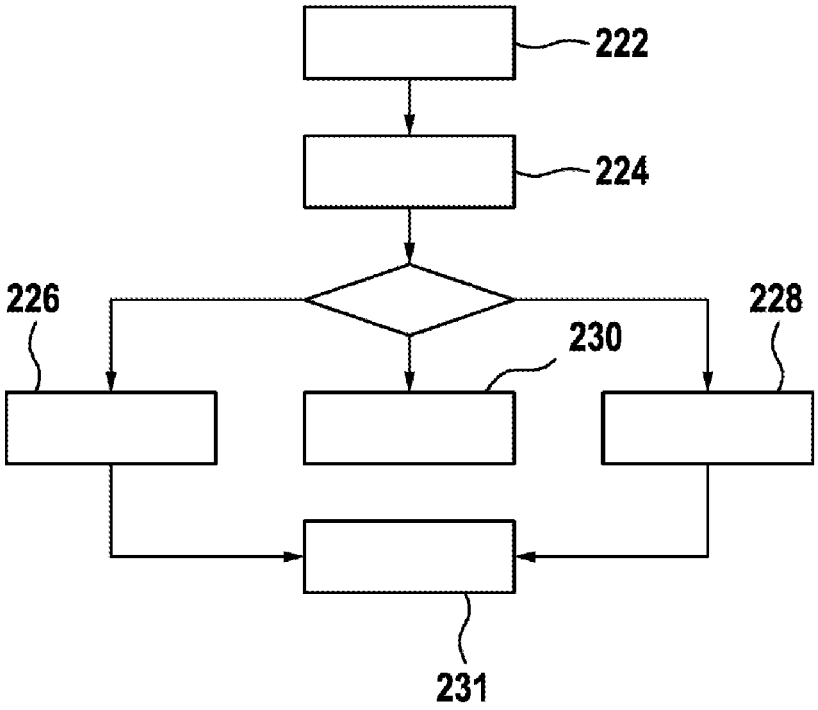
FIG. 11*a* a flow diagram of a procedure for selecting a parameter set for a rotation detection unit.

In FIG. 11*a*, in a step 222, two parameter sets are provided to the rotation detection unit 204, or to the electronics system 40. The provision is effected, for example, by the storage of the two parameter sets on a storage unit of the electronics system 40, not represented.

In a further step 224, an instantaneous rotational speed of the drive unit 20 is provided to the electronics system 40. It is conceivable for the instantaneous rotational speed, or the actual rotational speed, to be determined by the electronics system 40 itself, for example by means of a current sensor or a Hall sensor.

If the instantaneous rotational speed corresponds substantially to a maximally settable instantaneous rotational speed, in a step 226 the electronics system 40 selects a first parameter set for the rotation detection unit 204.

If the instantaneous rotational speed corresponds to a range of between 50% and 100% of the maximally settable instantaneous rotational speed, in a step 228 the electronics system 40 selects a second parameter set for the rotation detection unit 204.

If the provided instantaneous rotational speed corresponds to a range below 50% of the maximally settable instantaneous rotational speed, the rotation detection unit 204 is deactivated in a step 230.

The first parameter set has a lower threshold than the second parameter set for determination of a rotation of the housing. Thus, if a motion variable sensed by the sensor unit 205 is provided to the electronics system 40, or the rotation detection unit 204, it is compared with the threshold of the first or the second parameter set, and the rotation of the housing is not determined, or is determined much later, if the instantaneous rotational speed does not correspond to the maximally settable instantaneous rotational speed. In this case also, advantageously, the number of false triggers can thus be reduced significantly. If a rotation of the housing is determined, then in a step 231 the drive unit 20, in particular the electric motor 18, is braked to a standstill.

Figure 11B:
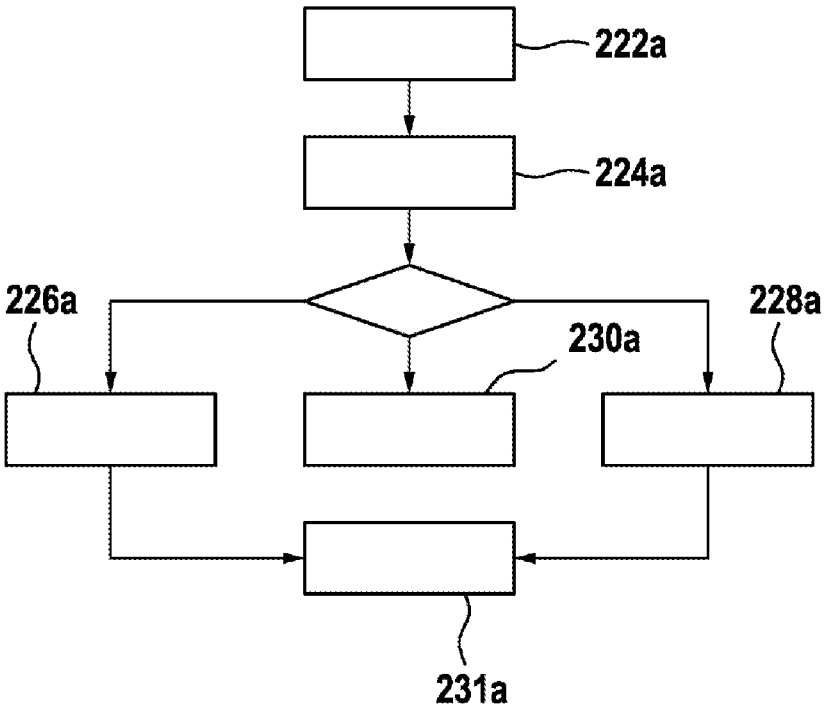
FIG. 11*b* a flow diagram of a further procedure for selecting a parameter set for a rotation detection unit.

In FIG. 11*b*, in a step 222*a*, two parameter sets are provided to the rotation detection unit 204*a*, or to the electronics system 40. The provision is effected, for example, by the storage of the two parameter sets on a storage unit of the electronics system 40, not represented.

In a further step 224*a*, a switching position is provided to the electronics system 40. If the switching position corresponds to a clockwise hammer-drilling mode, in a step 226*a* the electronics system 40 selects a first parameter set for the rotation detection unit 204. If the switching position corresponds to an anti-clockwise hammer-drilling mode, in a step 228*a* the electronics system 40 selects a second parameter set for the rotation detection unit 204. If the switching position corresponds to a chiseling mode, the rotation detection unit 204 is deactivated in a step 230*a*.

The parameter sets differ, in particular, in a threshold dependent on the direction of rotation. In this context, a threshold dependent on the direction of rotation is to be understood to mean, in particular, that the threshold is selected in such a manner that a comparable rotation of the hand-held power tool in opposite directions is determined to a different extent or only in one of the two opposite directions. The comparable rotations in opposite directions in this case have substantially the same acceleration, speed, distance and angle of rotation. In particular, the threshold of the first parameter set is selected in such a manner that in clockwise rotation the determination of a clockwise rotation of the hand-held power tool is more sensitive, or triggers earlier, than a determination of an anti-clockwise rotation of the hand-held power tool. In addition, the threshold of the second parameter set is selected in such a manner that the determination of the anti-clockwise rotation of the hand-held power tool in anti-clockwise rotation is more sensitive or triggers earlier than the determination of the clockwise rotation of the hand-held power tool. In this way, advantageously, the number of false triggers can be reduced. Alternatively, it is also conceivable for the rotation-direction-dependent threshold of the first, or second, parameter set to be selected in such a manner that only clockwise or anti-clockwise rotation can be determined. The rotation detection in clockwise rotation would thus be switched off for an anti-clockwise rotation of the housing.

This may be realized, for example, by the sensing of a motion variable that is dependent on the direction of rotation. A motion variable that is dependent on the direction of rotation can be sensed by used of an inertial sensor system such as, for example, an acceleration sensor, preferably a 3-axis acceleration sensor, and/or a rotation rate sensor. In particular, a motion variable can be sensed along a tangential direction with respect to the work axis 29, via which a tangential acceleration, a tangential velocity and/or a tangential distance can be determined. Preferably, the motion variable along the tangential direction is filtered by means of a high-pass filter and a low-pass filter.

Thus, for example, the acceleration sensor may be realized in such a manner that the motion variable sensed is positive when the housing rotates clockwise, and is negative when the housing rotates anti-clockwise. If the motion variable in clockwise rotation exceeds a determined threshold, in particular a positive threshold, the drive unit 20, in particular the electric motor 18, is braked to a standstill in a step 231*a*. If the motion variable in anti-clockwise rotation falls below a determined, in particular negative threshold, the drive unit 20, in particular the electric motor 18, is likewise braked to a standstill in a step 231*a*.

Figure 12:
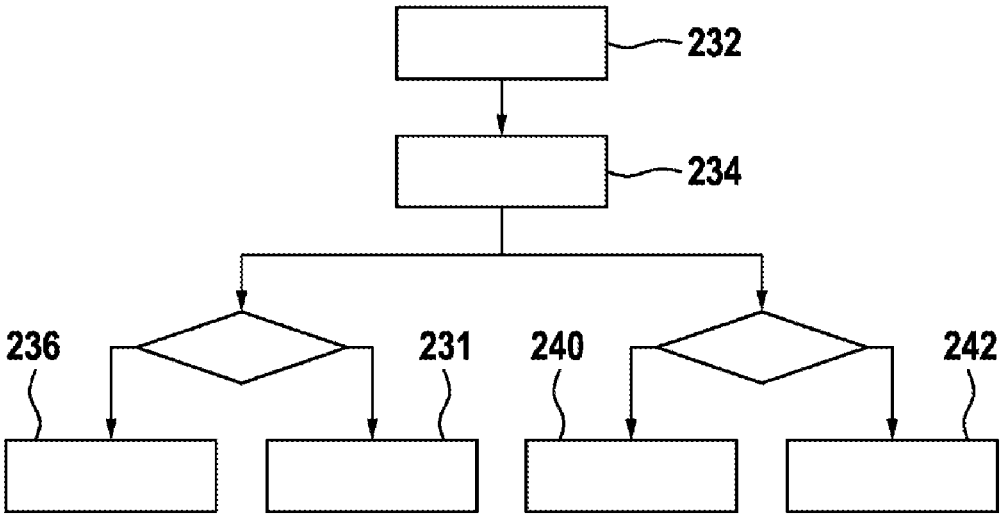
FIG. 12 a flow diagram of a procedure for selecting a parameter set for a percussion detection unit and a rotation detection unit.

In FIG. 12, in a step 232, two parameter sets are provided in each case to the percussion detection unit 202 and to the rotation detection unit 204. The provision is effected, for example, by the storage of the two parameter sets on a storage unit of the electronics system 40, not represented.

In a further step 234, a weight parameter of the battery pack 38 is provided to the electronics system 40. The weight parameter is stored, for example, in the battery pack 38, and is transmitted to the hand-held power tool 10 when the battery pack 38 is connected to the latter. Alternatively, it would be conceivable for the electronics system 40 of the hand-held power tool 10 to determine, or estimate, the weight parameter on the basis of the current provided by the battery pack 38.

Two threshold comparisons are effected on the basis of the weight parameter. If the provided weight parameter is above the first threshold, or if the weight of the battery pack is above the first threshold, then, in a step 236, a first parameter set for the percussion detection unit 202 is selected by the electronics system 40. If the provided weight parameter is below the first threshold, then, in a step 238, a second parameter set for the percussion detection unit 202 is selected by the electronics system 40. The heavy the battery pack, or entire system composed of the hand-held power tool 10 and the battery pack 38, the lower the motion variable sensed by the sensor unit 205, or the vibrations acting upon the housing 12. The first parameter set for the percussion detection unit 202 therefore has a lower threshold for determination of the percussion mode than the second parameter set, in order that the percussion mode can still be determined reliably, even if the system is of a greater weight.

If the weight parameter is above a second threshold, then, in a step 240, a first parameter set for the rotation detection unit 204 is selected by the electronics 40. If the weight parameter is below a second threshold, then, in a step 242, a second parameter set for the rotation detection unit 204 is selected by the electronics 40. The first parameter set for the rotation detection unit 204 has a lower threshold than the second parameter set for the rotation detection unit 204. Advantageously, this ensures that the rotation of the housing 12 of the hand-held power tool 10 is detected sufficiently rapidly to protect the user, even in the case of a heavy and inert system. By way of example, the first threshold and the second threshold are substantially identical in design. It is also conceivable, however, for the first and the second threshold to differ in design.

Figure 13:
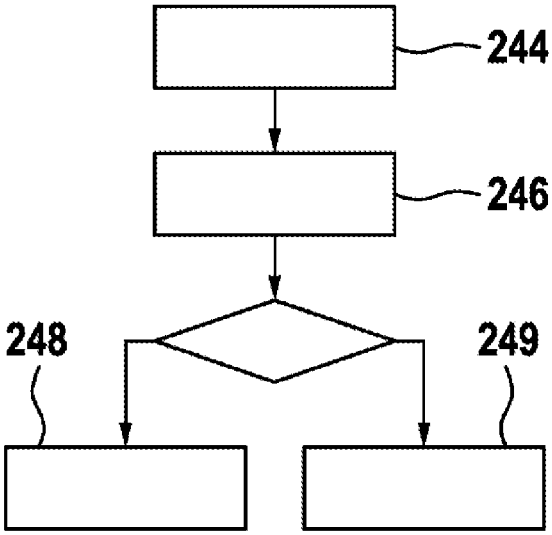
FIG. 13 a flow diagram of a further procedure for selecting a parameter set for a percussion detection unit.

In FIG. 13, in a step 244, two parameter sets are provided to the percussion detection unit 202. In a further step 246, a battery-pack operating parameter of the battery pack 38 is provided to the electronics system 40. The battery-pack operating parameter is transmitted, for example, from the battery pack 38 to the electronics system 40 of the hand-held power tool 10. It would also be conceivable for the battery-pack operating parameter to be determined by the electronics system 40 itself, for example via a connection to the power contacts of the battery pack 38. The battery-pack operating parameter is realized, for example, as available current.

In a threshold value procedure, the battery-pack parameter, realized as available current, is compared with an optimal current. The optimal current in this case corresponds to a current at which the hand-held power tool 10 has a substantially maximal operating power. If the available current corresponds substantially to the optimal current, or if the available current is in a range of 10% of the optimal current, then, in a step 248, a first parameter set for the percussion detection unit 202 is selected by the electronics system 40. Otherwise, a second parameter set for the percussion detection unit 202 is selected by the electronics system 40 in a step 249.

The first parameter set and the second parameter set in this case have the same idling rotational speed at which the drive unit 20 is driven in an idling mode determined by the percussion detection unit 202. The second parameter set has a lower percussion rotational speed than the first parameter set, at which the drive unit 20 is driven in a percussion mode determined by the percussion detection unit 202. Advantageously, the reduced percussion frequency at an available current that does not correspond to an optimal current can signal to the user that maximum power is not available, and that the battery pack 38 needs to be changed or charged. Preferably, the percussion rotational speed of the second parameter set is at least 10% lower, preferably at least 20% lower, preferably at least 30% lower, than the percussion rotation speed of the first parameter set.

Figure 14:
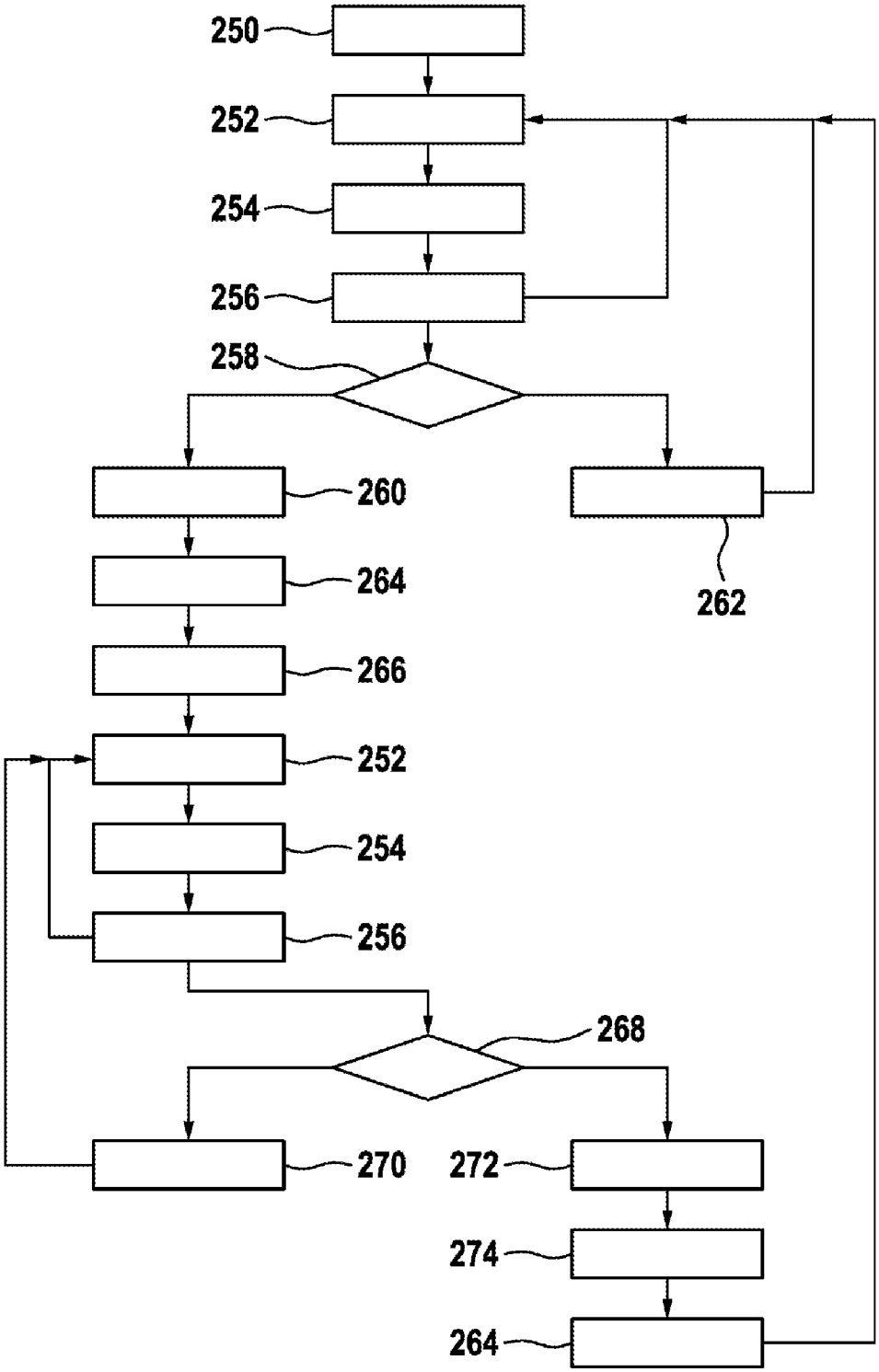
FIG. 14 a flow diagram for automatically controlling the drive unit by means of the percussion detection unit.

Represented schematically in FIG. 14, in a flow diagram, is a procedure for automatically controlling the rotational speed of the hand-held power tool 10, by open-loop or closed-loop control, by means of the percussion detection unit 202.

In a first procedure step 250, the electronics system 40 of the hand-held power tool 10 is initialized. The initialization is effected upon the hand-held power tool 10 being put into operation, in particular upon actuation of the operating switch 32. In this initialization step, an idling mode is determined, or set, by the electronics system 40, or the percussion detection unit 202, such that the drive unit 20 can be driven maximally at an idling rotational speed.

Figure 15:
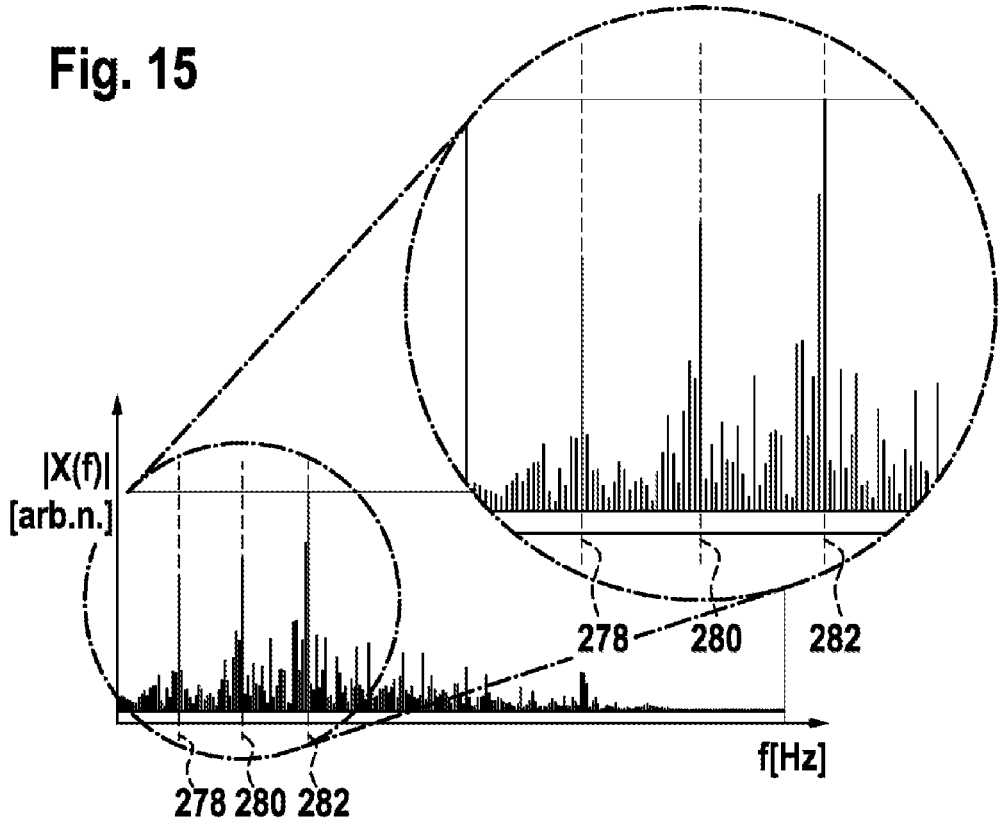
FIG. 15 an example of a frequency spectrum of a motion variable.

In a further step 252, a motion variable is sensed by the acceleration sensor 206 of the sensor unit 205. FIG. 15 shows an example of a frequency spectrum of the motion variable, the motion variable having been sensed during percussion operation. The acceleration sensor 206 is designed, in particular, to sense at least one second harmonic 282 of a percussion frequency 278 of the percussion mechanism 24. For example, the acceleration sensor 206 is designed to sense the motion variable in a frequency range of between 0 and 200 Hz. The frequency spectrum has three peaks, or maxima, the first peak corresponding to the percussion frequency 278 of the percussion mechanism 24. The percussion frequency 278 is, for example, approximately 40 Hz. The second peak corresponds to the first harmonic 280 of the percussion frequency 278, at approximately 80 Hz, and the third peak corresponds to the second harmonic 282 of the percussion frequency 278, at approximately 120 Hz. The sensing of the motion variable is effected, for example, every 5 ms, an thus the sensing interval is, for example, 5 ms. However, shorter sensing intervals such as, for example, 2 ms or under 1 ms, are also conceivable in order to increase the number of sensed motion variables, or to improve the accuracy of the determination of the percussion mode.

In a step 254, the motion variable if filtered by means of a filter unit. The filter unit is realized, for example, as a high-pass filter that has a cut-off frequency below the percussion frequency 278. For example, the cut-off frequency is 20 Hz, but a cut-off frequency of 10 Hz is also advantageous. The high-pass filter is realized as an IIR filter, the filter characteristic of which corresponds to a Chebyscheff filter. This advantageously enables a good edge steepness to be realized in the passband range. Alternatively, it is also conceivable for the filter characteristic to correspond to a Bessel filter. This advantageously enables a constant group delay time to be realized in the passband range. Conceivable as a further advantageous alternative is a filter characteristic that corresponds to a Butterworth filter. This advantageously enables a good amplitude response to be realized in the passband range and stop range.

In a step 256, the filtered motion variable 284 is provided to the electronics system 40, or the percussion detection unit 202. The electronics system 40, or the percussion detection unit 202, has a verification interval 285, in which a threshold value procedure 258 is executed. The verification interval 286 is in a range of between two and three percussion periods, for example approximately 50 ms. Within a verification interval, therefore, the steps 252, 254 and 256 are repeated a total of ten times until the threshold value procedure can be executed on the basis of the sensed motion variables.

Various threshold value procedures are conceivable for determining the percussion mode on the basis of the filtered motion variable. For example, a mean value or a median value of the motion variable within the verification interval may be determined, and this may be compared with a threshold or with a previously determined mean value or median value. Alternatively, it would also be conceivable for only a maximum or minimum value of the motion variable in the verification interval to be compared with a threshold or with a previous value.

Figure 16:
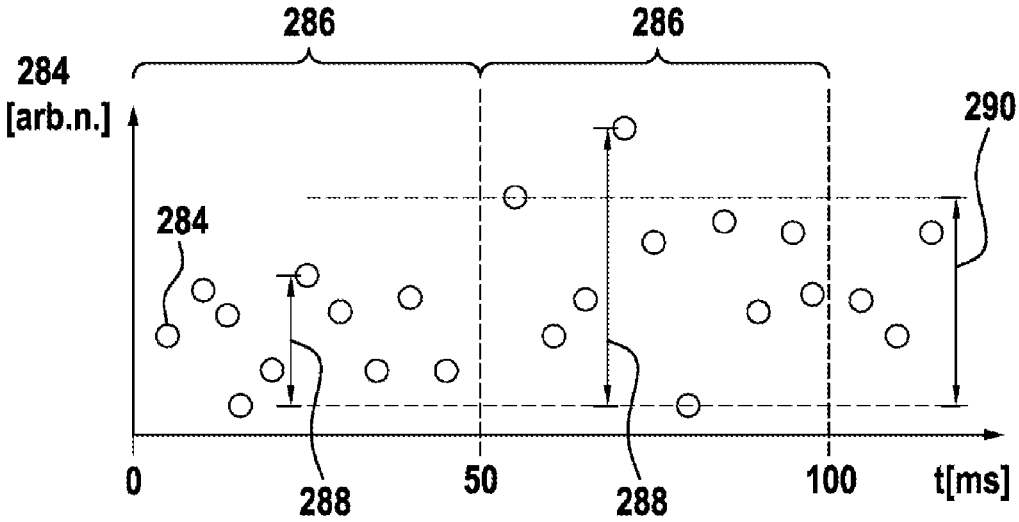
FIG. 16 an example of a threshold value procedure.

The threshold value procedure, used as an example, is represented schematically in FIG. 16. A maximum value and a minimum value of the filtered motion variable 284 is determined within the verification interval 286, and the difference 288 is formed from these two values. This difference 288 is compared with a threshold 290. If the difference 288 is greater than a threshold 290, a percussion mode is determined in a step 260. If the difference 288 is less than the threshold 290, an idling mode is determined in a step 262. In the example shown, an idling mode is determined in the first verification interval 286 and a percussion mode is determined in the second verification interval 286.

If the percussion mode is determined, the rotational speed of the drive unit 20 is increased, in a step 264, from an idling rotational speed to a percussion rotational speed. Advantageously, the idling frequency of the percussion mechanism 24 is thereby also increased to a percussion frequency of the percussion mechanism 24, thereby increasing the material removal rate of the hand-held power tool 10.

Following the changing of the rotational speed, the determination of the percussion mode, or idling mode, is paused in a step 266. For this purpose, the electronics system 40, or the percussion detection unit 202, has a pause interval in which the determination of the percussion mode, or idling mode, is paused. In particular, the pause interval is longer than the verification interval 286. Preferably, the pause interval is at least twice as long as the verification interval 286, preferably at least four times as long as the verification interval. In this way, advantageously, toggle effects can be avoided.

Following the pause interval, the steps 252, 254 and 256 are repeated, and the filtered motion variables are provided to the electronics system 40, or the percussion detection unit 202. In the percussion mode the filtered motion variables undergo a threshold value procedure 268, which corresponds substantially to the threshold value procedure 258 in the idling mode. The two threshold value procedures 258, 268 differ, in particular, in the verification interval, which is different. In particular, the verification interval in the percussion mode is longer than in the idling mode. Preferably, the verification interval in the percussion mode is at least 50% longer than in the idling mode, preferably at least twice as long. Alternatively or addition, it would likewise be conceivable for the threshold in the percussion mode to be greater or less than in the idling mode. If the threshold is exceeded, a percussion mode is further determined in a step 270, and the threshold value procedure 268 is executed repeatedly.

If the value is below the threshold, an idling mode is determined in a step 272. The percussion rotational speed of the drive unit 20 is thereupon reduced to an idling speed in a step 274, and a pause analogous to the pause in percussion mode follows in a step 264. The threshold value procedure 258 is then executed again in the idling mode until a percussion mode is determined.

The thresholds in the threshold value procedures 258, 268 in this case are dynamic. In particular, the dynamic threshold is selected in dependence on a position of the hand-held power tool, an operating-mode switch position, an operating-switch position, a weight of a battery pack, an instantaneous rotational speed, etc. Alternatively, it would likewise be conceivable for the thresholds in the threshold value procedures 258, 268 to be static, and therefore always the same.

The invention claimed is:

1. A hand-held power tool comprising:

a drive unit;

a housing in which the drive unit is mounted;

a tool receiver configured to detachably receive an insert tool, the insert tool configured to be driven at least one of percussively and rotationally by the drive unit;

a sensor unit configured to sense at least one motion variable; and an electronics system configured to:

control at least the drive unit by open-loop or closed-loop control;

automatically select a parameter set from at least two parameter sets;

determine a percussion mode of the hand-held power tool using the selected parameter set from the at least two parameter sets and based on the at least one motion variable; and control the drive unit based on the determined percussion mode of the hand-held power tool, wherein the at least two parameter sets are configured such that determination of the percussion mode by use of a first parameter set from the at least two parameter sets differs from determination of the percussion mode by use of a second parameter set from the at least two parameter sets.

2. The hand-held power tool as claimed in claim 1, wherein a first parameter set and a second parameter from the at least two parameter sets set differ at least in a threshold.

3. The hand-held power tool as claimed in claim 1, wherein the at least two parameter sets are configured such that control of the drive unit based on the determined percussion mode by use of a first parameter set from the at least two parameter sets differs from control of the drive unit based on the determined percussion mode by use of a second parameter set from the at least two parameter sets.

4. The hand-held power tool as claimed in claim 1, wherein a first parameter set and a second parameter set from the at least two parameter sets differ at least in a percussion frequency.

5. The hand-held power tool as claimed in claim 1, further comprising:

an operating switch configured to manually control the drive unit; and an operating-switch position unit operably connected to the operating switch and configured to determine a position of the operating switch and to provide the determined position to the electronics system.

6. The hand-held power tool as claimed in claim 5, further comprising:

a battery pack, wherein a battery-pack operating parameter is configured to be provided to the electronics system.

7. The hand-held power tool as claimed in claim 6, wherein the electronics system is configured to select the selected parameter set from the at least two parameter sets based on at least one of the operating switch position, an instantaneous rotational speed of an electric motor of the drive unit, a weight parameter, and the battery-pack operating parameter.

8. A hand-held power tool comprising:

a drive unit;

a housing in which the drive unit is mounted;

a tool receiver configured to detachably receive an insert tool, the insert tool configured to be driven at least one of percussively and rotationally by the drive unit;

a sensor unit configured to sense at least one motion variable; and an electronics system configured to:

control at least the drive unit by open-loop or closed-loop control;

automatically select a parameter set from at least two parameter sets;

determine a percussion mode of the hand-held power tool using the selected parameter set from the at least two parameter sets and based on the at least one motion variable; and control the drive unit based on the determined percussion mode of the hand-held power tool, wherein the at least two parameter sets are configured such that control of the drive unit based on the determined percussion mode by use of a first parameter set from the at least two parameter sets differs from control of the drive unit based on the determined percussion mode by use of a second parameter set from the at least two parameter sets.

9. A hand-held power tool comprising:

a drive unit;

a housing in which the drive unit is mounted;

a tool receiver configured to detachably receive an insert tool, the insert tool configured to be driven at least one of percussively and rotationally by the drive unit;

a sensor unit configured to sense at least one motion variable; and an electronics system configured to:

control at least the drive unit by open-loop or closed-loop control;

automatically select a parameter set from at least two parameter sets;

determine a percussion mode of the hand-held power tool using the selected parameter set from the at least two parameter sets and based on the at least one motion variable; and control the drive unit based on the determined percussion mode of the hand-held power tool, wherein a first parameter set and a second parameter set from the at least two parameter sets differ at least in a percussion frequency.

* * * * *